US009401115B2

(12) United States Patent
Asano et al.

(10) Patent No.: US 9,401,115 B2
(45) Date of Patent: Jul. 26, 2016

(54) LIQUID CRYSTAL DISPLAY WITH A HIGHER LUMINANCE SUB-PIXEL INCLUDING CONTROLLABLE LIGHT EMISSION SUBSECTIONS

(75) Inventors: Mitsuyasu Asano, Tokyo (JP); Tomohiro Nishi, Tokyo (JP); Tomoya Yano, Kanagawa (JP); Ken Kikuchi, Tokyo (JP)

(73) Assignee: SONY CORPORATION, Tokyo (JP)

( * ) Notice: Subject to any disclaimer, the term of this patent is extended or adjusted under 35 U.S.C. 154(b) by 227 days.

(21) Appl. No.: 13/095,104

(22) Filed: Apr. 27, 2011

(65) Prior Publication Data

US 2011/0285762 A1 Nov. 24, 2011

(30) Foreign Application Priority Data

May 18, 2010 (JP) ..... 2010-114656

(51) Int. Cl.
*G09G 3/34* (2006.01)
*G09G 3/36* (2006.01)

(52) U.S. Cl.
CPC ..... *G09G 3/3426* (2013.01); *G09G 2300/023* (2013.01); *G09G 2300/0452* (2013.01); *G09G 2320/0646* (2013.01); *G09G 2340/06* (2013.01); *G09G 2360/16* (2013.01)

(58) Field of Classification Search
CPC ..... G06F 3/34; G06F 3/36; G09G 3/3426; G09G 2300/023; G09G 2300/0452; G09G 2360/16; G09G 2320/0646; G09G 2340/06
USPC ..... 345/87–104, 690–696
See application file for complete search history.

(56) References Cited

U.S. PATENT DOCUMENTS

2005/0104841 A1* 5/2005 Sohn et al. ..... 345/102
2005/0140612 A1* 6/2005 Baek ..... G09G 3/2003 345/83

(Continued)

FOREIGN PATENT DOCUMENTS

JP 2001-142409 5/2001
JP 4354491 8/2009

OTHER PUBLICATIONS

U.S. Appl. No. 13/026,596, filed Feb. 14, 2011, Asano, et al.

(Continued)

*Primary Examiner* — Temesgh Ghebretinsae
*Assistant Examiner* — Lisa Landis
(74) *Attorney, Agent, or Firm* — Oblon, McClelland, Maier & Neustadt, L.L.P

(57) ABSTRACT

A liquid crystal display includes: a light source section including emission subsections; a LCD panel including pixels each having sub-pixels for four colors of R, G, B, and Z, and modulating light from the emission subsections based on input image signals for three colors of R, G, and B; and a display control section including a partitioning-drive processing section, driving the emission subsections with an emission pattern signal, and driving the four sub-pixels with partitioning-drive image signals for the four colors. The partitioning-drive processing section generates pixel signals for the four colors through performing a first color-conversion based on the input image signals, generates the emission pattern signal from pixel signals for the three colors, primary partitioning-drive image signals for the three colors from both the input image signals and the emission pattern signal, and the partitioning-drive image signals through performing a second color-conversion on the primary partitioning-drive image signals.

10 Claims, 19 Drawing Sheets

(56) References Cited

U.S. PATENT DOCUMENTS

2008/0068359 A1* 3/2008 Yoshida ..... G09G 3/3406 345/204
2008/0180384 A1* 7/2008 Aoki ..... G02F 1/133514 345/102
2008/0186334 A1* 8/2008 Seetzen ..... G09G 3/3413 345/690
2008/0198180 A1* 8/2008 Langendijk ..... G09G 3/2003 345/690
2008/0252666 A1* 10/2008 Chen ..... G09G 3/2044 345/690
2009/0135127 A1* 5/2009 Lee et al. ..... 345/102
2009/0262148 A1* 10/2009 Kimura ..... 345/690
2009/0278867 A1* 11/2009 Brown Elliott et al. ..... 345/690
2010/0295879 A1* 11/2010 Tanaka et al. ..... 345/690
2011/0025592 A1* 2/2011 Botzas et al. ..... 345/102
2011/0193895 A1* 8/2011 Johnson ..... G09G 3/3426 345/690
2011/0273377 A1* 11/2011 Merz ..... 345/173

OTHER PUBLICATIONS

U.S. Appl. No. 13/030,417, filed Feb. 18, 2011, Asano, et al.
U.S. Appl. No. 13/016,138, filed Jan. 28, 2011, Asano, et al.
U.S. Appl. No. 13/074,617, filed Mar. 29, 2011, Asano, et al.
U.S. Appl. No. 13/070,965, filed Mar. 24, 2011, Asano, et al.
U.S. Appl. No. 13/082,809, filed Apr. 8, 2011, Asano, et al.
U.S. Appl. No. 13/156,835, filed Jun. 9, 2011, Yano, et al.
U.S. Appl. No. 13/181,765, filed Jul. 13, 2011, Kikuchi, et al.
U.S. Appl. No. 14/570,872, filed Dec. 15, 2014, Asano, et al.

* cited by examiner

LIQUID CRYSTAL DISPLAY WITH A HIGHER LUMINANCE SUB-PIXEL INCLUDING CONTROLLABLE LIGHT EMISSION SUBSECTIONS

BACKGROUND

The present disclosure relates to a liquid crystal display (hereinafter referred to as LCD) provided with a light source section having a plurality of emission subsections.

In recent years, as a thin-screen television and a display of a portable terminal device, an active matrix type of LCD in which a thin film transistor (TFT) is provided for each pixel has been often used. In such a LCD, each pixel is driven by line-sequentially writing an image signal in an auxiliary capacitive element and a liquid crystal element of each pixel from an upper part to a lower part of a screen.

As a backlight used in the LCD, a backlight using a cold cathode fluorescent lamp (CCFL) as a light source is mainstream, but in recent years, a backlight using a light emitting diode (LED) has also appeared.

For the LCD that employs such an LED as a backlight, there has been proposed, in related art, a technique in which a light source section is divided into a plurality of emission subsections, and which performs emission operation independently on this emission subsection basis (for example, see Japanese Unexamined Patent Application Publication No. 2001-142409). At the time of such sub-sectional emission operation, each of an emission pattern signal indicating an emission pattern for each emission subsections in the backlight and a partitioning-drive image signal is generated based on an input image signal.

Meanwhile, in order to achieve low power consumption at the time of image display in the LCD, a technique in which each pixel in a LCD panel includes sub-pixels of four colors has been proposed. These sub-pixels of four colors are, specifically, a red (R)-sub-pixels, a green (G)-sub-pixel, a blue (B)-sub-pixel, and a Z-sub-pixel, Z-sub-pixel exhibiting a color of Z (for example, white (W), yellow (Y), or the like) with luminance higher than that of the R-, G-, and B-sub-pixels. When image display is performed by using image signals for such sub-pixels of four colors, as compared to a case in which image display is performed by supplying an image signal for three colors to each pixel having a sub-pixel structure of three colors of R, G, and B as in the past, luminance efficiency may be improved. In other words, display luminance may be maintained while the signal level is reduced and thus, low power consumption may be achieved as compared to a LCD having the sub-pixel structure of the three colors in the past.

In addition, Japanese Patent No. 4354491 proposes the combination of the above-described two techniques, namely, a technique in which sub-sectional emission operation is performed in a LCD having a sub-pixel structure of four colors of R, G, B, and W.

SUMMARY

However, in this Japanese Patent No. 4354491, after three input image signals for R, G, and B are subjected to color conversion process and thereby four pixel signals for R, G, B, and W are generated, each of the above-mentioned emission pattern signal and partitioning-drive image signal is generated based on the four pixel signals. Therefore, by the technique in this Japanese Patent No. 4354491, the circuit scale and the like increase, making it difficult to achieve a reduction in size, as compared to a case in which the emission pattern signal and the partitioning-drive image signal are generated based on the three image signal as in the past. In other words, the combination of the above-described two techniques makes the power consumption lower than before, but it is difficult to reduce the cost.

Meanwhile, it is conceivable to use a technique different from that of Japanese Patent No. 4354491, when the sub-sectional emission operation is performed in the LCD having the sub-pixel structure of four colors R, G, B, and Z (W or the like). In other words, there is a technique in which, in a manner opposite to that in Japanese Patent No. 4354491 described above, the emission pattern signals and the partitioning-drive image signals are generated based on the three input image signals as in the past and then, the partitioning-drive image signal for each of the sub-pixels of the four colors is generated by color conversion process and supplied to each sub-pixel. In this technique, the emission pattern signals and the partitioning-drive image signals are generated based on the three input image signals and thus, unlike the technique in Japanese Patent No. 4354491 described above, an increase in the circuit scale and the like does not occur. In addition, because the partitioning-drive image signals for three colors thus generated are subjected to the color conversion process and the partitioning-drive image signals for each of the sub-pixels of four colors are ultimately generated, the signal level may be decreased for the image signals, and lower power consumption may also be achieved.

However, in this technique, the emission pattern signals are generated based on the three input image signals. For this reason, as compared to the case in which the emission pattern signals generated based on the four image signal (pixel signals) for R, G, B, and Z, an effect of improving luminance efficiency is not sufficient, which is also not enough to achieve low power consumption. In other words, with this technique, a decrease in cost may be realized by reducing the size, but it is difficult to realize low power consumption.

For the above reasons, there is desired a proposal of a technique that may realize compatibility between a reduction in cost and a reduction in power consumption at the time of image display using the sub-sectional emission operation in the LCD having the sub-pixel structure of four colors of R, G, B, and Z.

In view of the foregoing, it is desirable to provide a LCD which may be capable of realizing compatibility between a reduction in cost and a reduction in power consumption at the time of image display using a light source section that performs sub-sectional emission operation.

A LCD according to an embodiment of the present disclosure includes a light source section, a LCD panel, and a display control section. The light source section includes a plurality of emission subsections which may be capable of being controlled independently of each other. The LCD panel includes a plurality of pixels each having a red (R)-sub-pixel, a green (G)-sub-pixel, and a blue (B)-sub-pixel, and a Z-sub-pixel, a Z-sub-pixel exhibiting a color of Z with luminance higher than that of the R-, G-, and B-sub-pixels, and modulates light emitted from the light source section on the emission subsection basis, based on the three input image signals for R, G, and B, thereby performing image display. The display control section includes a partitioning-drive processing section that generates, based on the input image signals, each of an emission pattern signal indicating an emission pattern on the emission subsection basis in the light source section and four partitioning-drive image signals for R, G, B, and Z. Further, the display control section performs emission driving for each of the emission subsections of the light source section by using the emission pattern signal, and performs display driving for each of the sub-pixels of R, G, B, and Z in the LCD panel by using the partitioning-drive image signals. The partitioning-drive processing section generates four pixel signals for R, G, B, and Z, by performing first color conversion process based on the three input image signals, and also generates the emission pattern signal, based on the three pixel signals for R, G, and B of the four pixel signals. Further, the partitioning-drive processing section generates three primary partitioning-drive signals for R, G, and B, based on the three input image signals, and the emission pattern signal, and also generates the four partitioning-drive image signals, by subjecting the three primary partitioning-drive signals to second color conversion process.

In the LCD according to an embodiment of the present disclosure, based on the three input image signals, there is generated each of the emission pattern signal indicating the emission pattern on the emission subsection basis in the light source section and the four partitioning-drive image signals. And then, the emission driving for each of the emission subsections of the light source section is performed by using the emission pattern signal, and the display driving for each of the R-sub-pixel, the G-sub-pixel, the B-sub-pixel, and the Z-sub-pixel in the LCD panel is performed by using the partitioning-drive image signals. At the time, the first color conversion process is performed based on the three input image signals, and thereby the four pixel signals are generated and then, the emission pattern signal is generated based on the three pixel signals of the four pixel signals. This reduces the size of the part generating the emission pattern signal, as compared to a case where the emission pattern signal is generated by using the four pixel signals as they are. Further, the emission pattern signal is generated by using a part (the three pixel signals) of the four pixel signals obtained by performing the first color conversion processing of generating the pixel signal for the color (Z) indicating the luminance higher than that of R-, G-, and B-sub-pixels. For this reason, as compared to a case where the emission pattern signal is generated without performing the first color conversion process, display luminance is maintained while the signal level is reduced (luminance efficiency is improved). Furthermore, the three primary partitioning-drive signals are generated based on the input image signals and the emission pattern signal and then, this three primary partitioning-drive signals are subjected to the second color conversion process, and thereby the four partitioning-drive image signals are generated. This reduces the size of the part generating the partitioning-drive image signals, as compared to a case where after the four pixel signals are generated by subjecting the input image signals to color conversion process, the partitioning-drive image signals are generated by using the four pixel signals.

According to the LCD in the above-described embodiment of the present disclosure, the first color conversion process is performed based on the three input image signals and thereby the four pixel signals are generated and then, the emission pattern signal is generated based on the three pixel signals of these four pixel signals. Therefore, the part generating the emission pattern signal may be reduced in size and also, the display luminance may be maintained while the signal level is reduced. Further, the three primary partitioning-drive signals are generated based on the input image signals and the emission pattern signal and then, these three primary partitioning-drive signals are subjected to the second color conversion process and thereby the four partitioning-drive image signals are generated. Therefore, the part generating the partitioning-drive image signals may be reduced in size. Accordingly, at the time of image display using the light source section that performs sub-sectional emission operation, compatibility between a reduction in cost and a reduction in power consumption may be realized.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION OF THE PREFERRED EMBODIMENTS

Embodiments of the present disclosure will be described in detail with reference to the drawings. Incidentally, the description will be provided in the following order.

1. First embodiment (example of image display using sub-sectional emission operation in RGBZ panel)
2. Second embodiment (example of image display using sub-sectional emission operation in RGBW panel)
3. Modifications (examples of edge light type of backlight and the like)

First Embodiment

Entire Structure of Liquid Crystal Display 1

Figure 1:
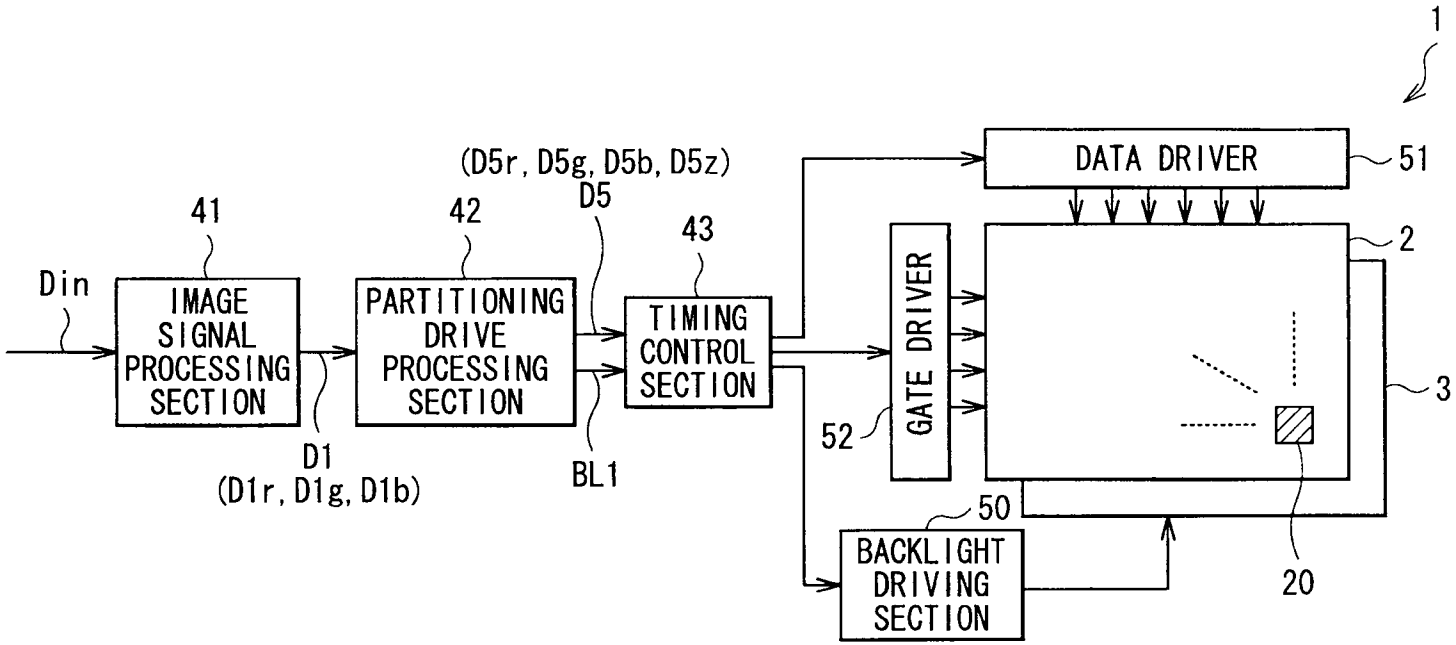
FIG. 1 is a block diagram illustrating the entire structure of a liquid crystal display (LCD) according to a first embodiment of the present disclosure.

FIG. 1 is a block diagram of the entire LCD (LCD 1) according to the first embodiment of the present disclosure.

The LCD 1 performs image display, based on an input image signal Din inputted externally. This LCD 1 includes a LCD panel 2, a backlight 3 (light source section), an image-signal processing section 41, a partitioning-drive processing section 42, a timing control section 43, a backlight driving section 50, a data driver 51 and a gate driver 52. Of these, the image-signal processing section 41, the partitioning-drive processing section 42, the timing control section 43, the backlight driving section 50, the data driver 51, and the gate driver 52 correspond to a specific example of the "display control section" according to the embodiment of the present disclosure.

The LCD panel 2 modulates the light emitted from the backlight 3 to be described later based on the input image signal Din, thereby performing image display based on this input image signal Din. This LCD panel 2 includes a plurality of pixels 20 arranged in the form of a matrix as a whole.

Figure 2A:
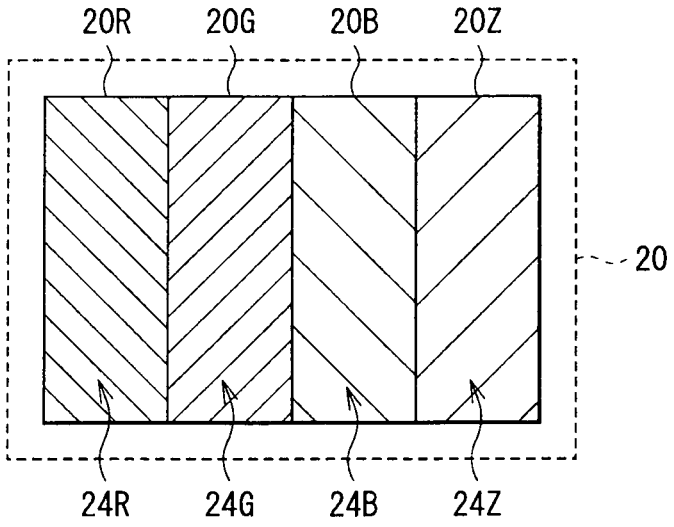
FIG. 2A and FIG. 2B are plan views each schematically illustrating an example of the sub-pixel structure of a pixel illustrated in FIG. 1.
Figure 2B:
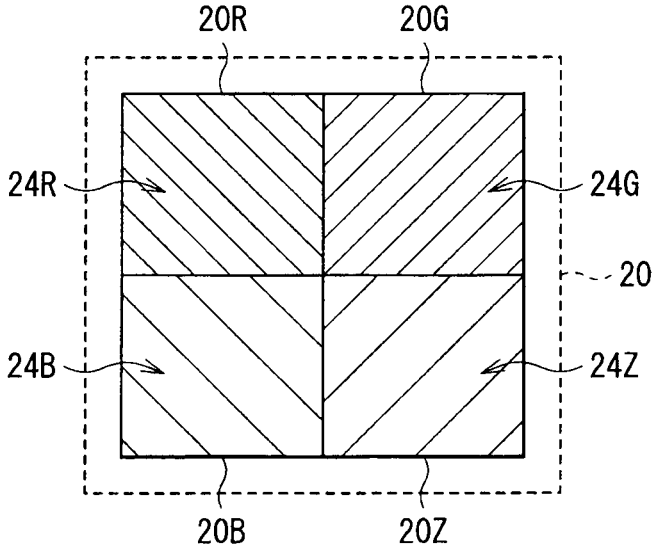

FIGS. 2A and 2B each illustrate an example of the sub-pixel structure in each of the pixels 20 in a schematic plan view. Each of the pixels 20 includes a sub pixel 20R corresponding to red (R) color, a sub-pixel 200 corresponding to green (G) color, a sub-pixel 20B corresponding to blue (B) color, and a sub-pixel 20Z exhibiting a color of (Z) with luminance higher than that of the R, G, and B. This color (Z) with higher luminance includes, for example, yellow (Y), white (W) and the like, but in the present embodiment, the color (Z) will be described as their superordinate concept. Among four sub-pixels, 20R, 20G, 20B, and 20Z of four colors R, G, B and Z, in three sub-pixels, 20R, 20G, and 20B corresponding to three colors of R, G and B, color filters 24R, 24G, and 24B corresponding to the respective colors of R, G, and B are disposed. In other words, the color filter 24R corresponding to R is disposed in the sub-pixel 20R corresponding to R, and the color filter 24G corresponding to G is disposed in the sub-pixel 200 corresponding to G, and the color filter 24B corresponding to B is disposed in the sub-pixel 20B corresponding to B. On the other hand, in the sub-pixel 20Z corresponding to Z, in a case where, for example, Z=Y, a color filter (a color filter 24Z illustrated in FIGS. 2A and 2B) corresponding to Y is disposed. However, as the details will be described in the second embodiment to be described later, in a case where Z=W, a color filter is not disposed in this sub–the pixel 20Z.

Here, in the example illustrated in FIG. 2A, within the pixel 20, the four sub-pixels 20R, 20G, 20B, and 20Z are arranged in a row in this order (along, for example, a horizontal (H) direction). On the other hand, in the example illustrated in FIG. 2B, within the pixel 20, the four sub-pixels 20R, 20G, 20B, and 20Z are arranged in the form of a matrix (like a grid) with two rows and two columns. However, the layout configuration of these four sub-pixels 0R, 20G, 20B, and 20Z in the pixel 20 is not limited to these examples, and may be other layout configuration.

In the pixel 20 of the present embodiment, by having such a sub-pixel structure of four colors, as the details will be described later, luminance efficiency at the time of image display may be improved, as compared to a case of a sub-pixel structure with three colors of R, G, and B in the past. In other words, the display luminance may be maintained while the luminance level of the backlight 3 at the time of image display is reduced and thus, lower power consumption may be achieved as compared to the LCD having the sub-pixel structure of three colors in the past.

Figure 3:
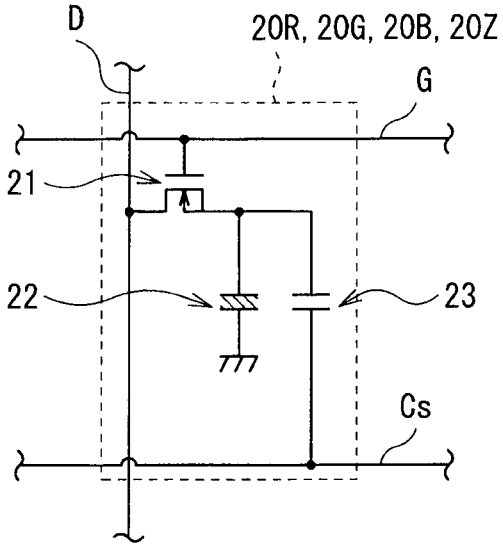
FIG. 3 is a circuit diagram illustrating an example of the detailed structure of each sub-pixel illustrated in FIG. 2A and FIG. 2B.

FIG. 3 illustrates an example of the structure of a pixel circuit in each of the sub-pixels 20R, 20G, 20B, and 20Z. Each of the sub-pixels 20R, 20G, 20B, and 20Z has a liquid crystal element 22, a TFT element 21, and an auxiliary capacitive element 23. To each of the sub-pixels 20R, 20G, 20B, and 20Z, a gate line G for line-sequentially selecting a pixel targeted for driving, a data line D for supplying an image voltage (an image voltage supplied from the data driver 51, which will be described later) to the pixel targeted for driving, and an auxiliary capacity line Cs are connected.

The liquid crystal element 22 performs display operation, according to the image voltage supplied from the data line D to one end of the liquid crystal element 22 through the TFT element 21. This liquid crystal element 22 is, for example, an element in which a liquid crystal layer (not illustrated) configured with liquid crystal in a VA (Vertical Alignment) mode or a TN (Twisted Nematic) mode is sandwiched between a pair of electrodes (not illustrated). One (one end) of the pair of electrodes in the liquid crystal element 22 is connected to the drain of the TFT element 21 and one end of the auxiliary capacitive element 23, and the other (the other end) is grounded. The auxiliary capacitive element 23 is a capacitive element for stabilizing stored charge of the liquid crystal element 22. The one end of this auxiliary capacitive element 23 is connected to the one end of the liquid crystal element 22 and the drain of the TFT element 21, and the other end is connected to the auxiliary capacity line Cs. The TFT element 21 is a switching element for supplying an image voltage based on an image signal D1 to the one end of each of the liquid crystal element 22 and the auxiliary capacitive element 23, and is configured to include a MOS-FET (Metal Oxide Semiconductor-Field Effect Transistor). Of this TFT element 21, the gate is connected to the gate line G, the source is connected to the data line D, and the drain is connected to the one end of each of the liquid crystal element 22 and the auxiliary capacitive element 23.

The backlight 3 is a light source section that emits the light to the LCD panel 2, and includes, for example, a CCFL or a LED as a emitting element (light source). In the backlight 3, as will be described later, emission driving is performed according to the contents (an image pattern) of the input image signal Din.

Figure 4:
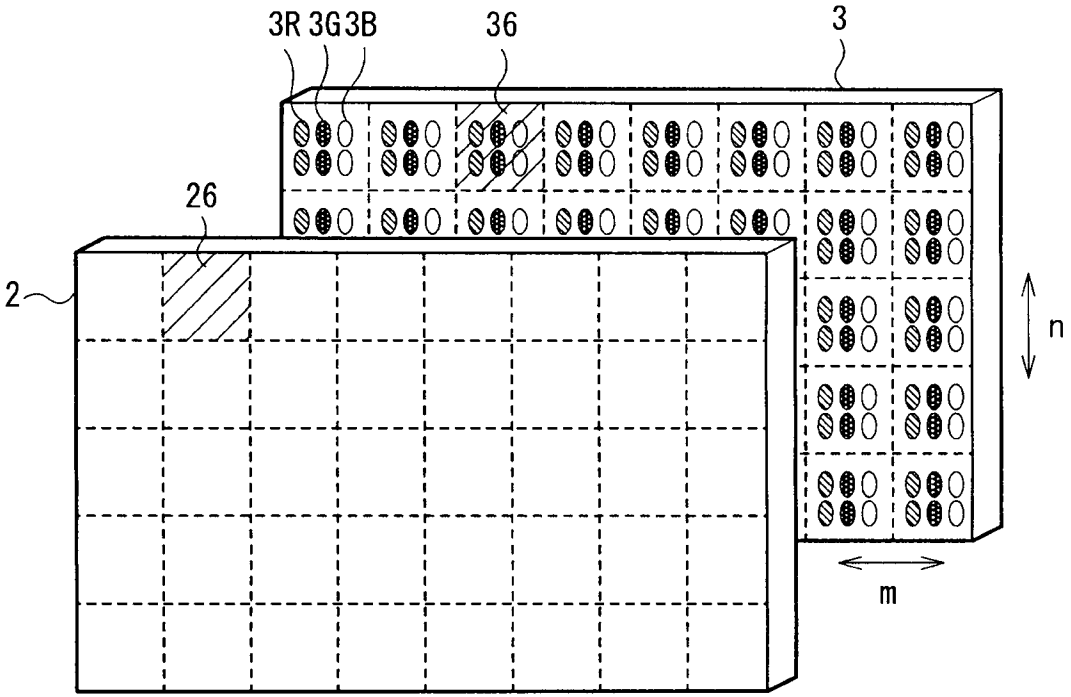
FIG. 4 is an exploded perspective view schematically illustrating an example of each of a sub-sectional emission area and an sub-sectional irradiation area in the LCD illustrated in FIG. 1.

This backlight 3 also has, as illustrated in, for example, FIG. 4, a plurality of sub-sectional emission areas 36 (emission subsections) configured to be controllable independently of each other. In other words, this backlight 3 is a backlight employing a partitioning-drive system. Specifically, in the backlight 3, the plurality of light sources are arranged two-dimensionally, and thereby the plurality of sub-sectional emission areas 36 are provided. Thus, the backlight 3 is divided into emission areas of n columns×m rows=K units (n, m=an integer of 2 or more) in an in-plane direction. Incidentally, the number of divisions is set to realize a resolution lower than that of the pixel 20 in the LCD panel 2 described above. In addition, as illustrated in FIG. 4, in the LCD panel 2, a plurality of sub-sectional irradiation areas 26 corresponding to the respective sub-sectional emission areas 36 are formed.

In this backlight 3, the emission may be controlled independently for each of the sub-sectional emission areas 36, according to the contents (image pattern) of the input image signal Din. In addition, the light source in the backlight 3 is configured here, for example, by combining LEDs of a red LED 3R that emits red light, a green LED 3G that emits green light, and a blue LED 3B that emits blue light. However, the type of the LED used for the light source is not limited to this example and, for example, a white LED that emits white light may be employed. Incidentally, at least one such a light source is disposed in each of the sub-sectional emission areas 36.

The image-signal processing section 41 subjects the input image signal Din including pixel signals corresponding to three primary colors of R, G, and B to, for example, predetermined image process (for example, sharpness process, gamma correction process, and the like) for increasing the image quality. As a result, the image signal D1 including pixel signals corresponding to three colors of R, G, and B (a pixel signal D1*r* for R, a pixel signal D1*g* for G, and a pixel signal D1*b* for B) is generated.

The partitioning-drive processing section 42 subjects the image signal D1 (D1*r*, D1*g*, D1*b*)) supplied from the image-signal processing section 41, to predetermined partitioning-drive process. As a result, each of a emission pattern signal BL1 indicating a emission pattern on the sub-sectional emission area 36 basis in the backlight 3, and a partitioning-drive image signal D5 (a pixel signal D5*r* for R, a pixel signal D5*g* for G, a pixel signal D5*b* for B, and a pixel signal D5*z* for Z) is generated. Incidentally, the structure of this partitioning-drive processing section 42 will be described later in detail (FIG. 5 to FIG. 9).

The timing control section 43 controls the timing for driving the backlight driving section 50, the gate driver 52, and the data driver 51, and supplies the data driver 51 with the partitioning-drive image signal D5 supplied from the partitioning-drive processing section 42.

The gate driver 52 line-sequentially drives, according to the timing control by the timing control section 43, each of the pixels 20 within the LCD panel 2 along the gate line G described above. On the other hand, the data driver 51 supplies each of the pixels 20 (each of the sub-pixels 20R, 20G, 20B, and 20Z) of the LCD panel 2 with the image voltage based on the partitioning-drive image signal D5 supplied from the timing control section 43. In other words, the sub-pixel 20R is supplied with the pixel signal D5*r* for R, the sub-pixel 20G is supplied with the pixel signal D5*g* for G the sub-pixel 20B is supplied with the pixel signal D5*b* for B, and the sub-pixel 20Z is supplied with the pixel signal D5*z* for Z. Specifically, the data driver 51 subjects the partitioning-drive image signal D5 to D/A (digital/analog) conversion, thereby generating the image signal (the above-mentioned image voltage) that is an analog signal, and outputting the generated image signal to each of the pixels 20 (each of the sub-pixels 20R, 20G 20B, and 20Z). In this way, display driving based on the partitioning-drive image signal D5 is performed for each of the pixels 20 (each of the sub-pixels 20R, 20G 20B, and 20Z) within the LCD panel 2.

The backlight driving section 50 performs, according to the timing control by the timing control section 43, emission driving (lighting driving) for each of the sub-sectional emission areas 36 in the backlight 3, based on the emission pattern signal BL1 outputted from the partitioning-drive processing section 42.

[Detailed Structure of Partitioning-Drive Processing Section 42]

Figure 5:
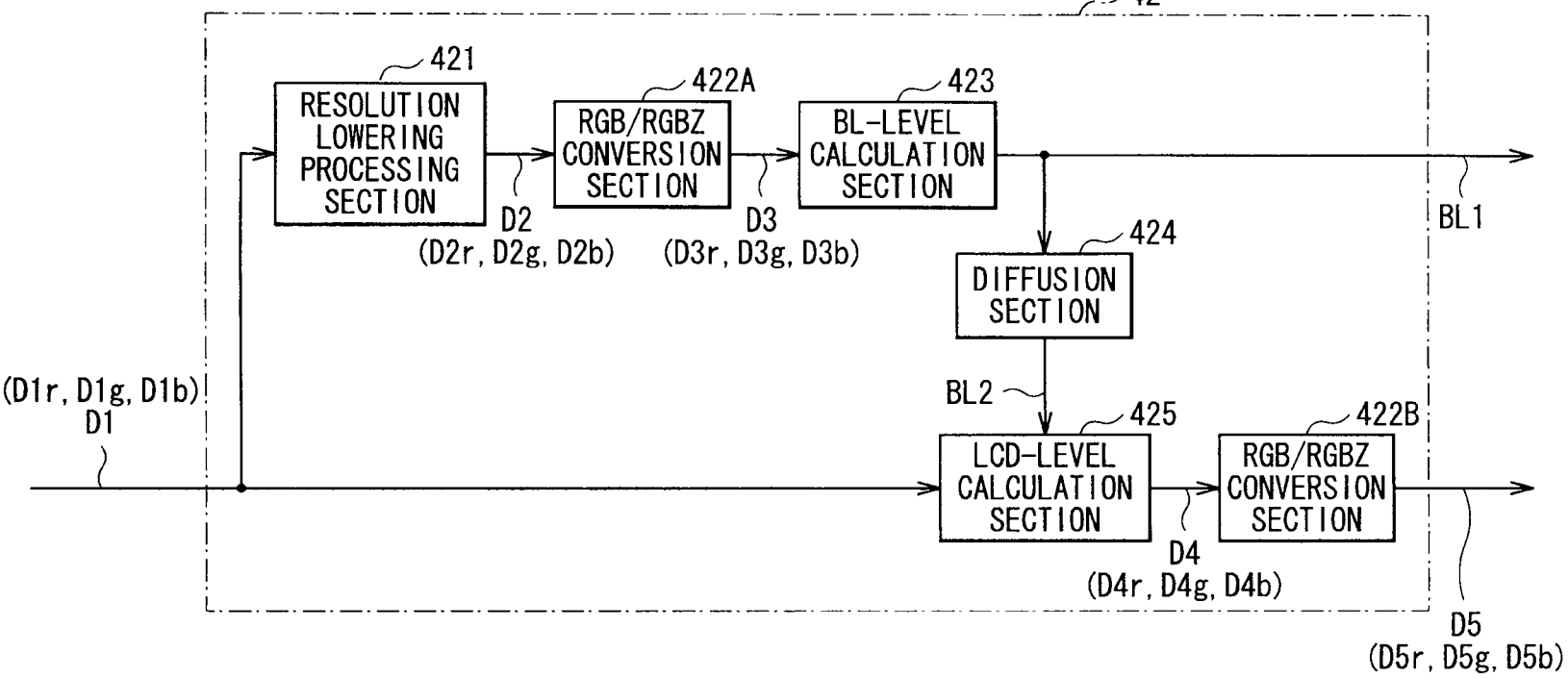
FIG. 5 is a block diagram illustrating a detailed structure of a partitioning-drive processing section illustrated in FIG. 1.

Next, with reference to FIG. 5 to FIG. 9, a detailed structure of the partitioning-drive processing section 42 will be described. FIG. 5 is a block diagram of the partitioning-drive processing section 42. This partitioning-drive processing section 42 includes a resolution-lowering processing section 421, RGB/RGBZ conversion sections 422A (first color conversion section) and 422B (second color conversion section), a BL-level calculation section 423 (emission pattern generation section), a diffusion section 424, and an LCD-level calculation section 425 (image-signal generation section).

The resolution-lowering processing section 421 subjects the image signal D1 to predetermined resolution-lowering process, thereby generating an image signal D2 (resolution-lowered signal) that becomes a basis for the emission pattern signal BL1 described above. Specifically, the image signal D1 including a luminance level signal (pixel signals D1*r*, D1*g*, and D1*b*) per pixel 20 is reconstructed to be a luminance level signal per sub-sectional emission area 36 whose resolution is lower than that of the pixel 20. Thus, the image signal D2 (a pixel signal D2*r* for R, a pixel signal D2*g* for G, and a pixel signal D2*b* for B) is generated. At the time, the resolution-lowering processing section 421 performs the reconstruction by extracting a predetermined amount of characteristic (for example, a maximum value or a mean value of the luminance level, or a synthetic value based on them, or other value) from a plurality of pixel signals within each of the sub-sectional emission areas 36.

Figure 6:
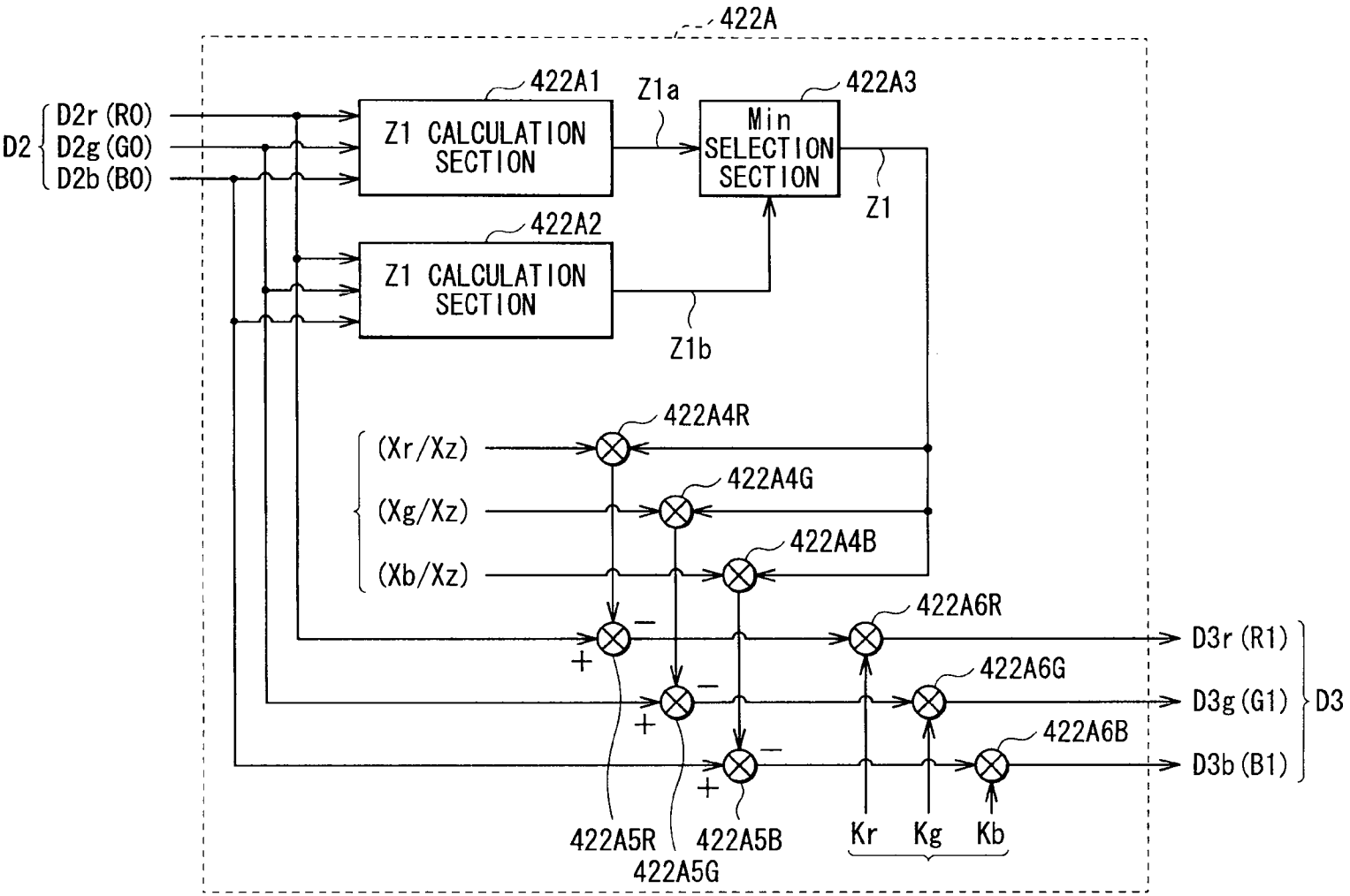
FIG. 6 is a block diagram illustrating a detailed structure of a RGB/RGBZ conversion section 422A illustrated in FIG. 5.

The RGB/RGBZ conversion section 422A subjects the image signal D2 corresponding to three colors of R, G, and B (pixel signals D2*r*, D2*g*, and D2*b*) to RGB/RGBZ conversion process (first color conversion process). As a result, pixel signals corresponding to four colors of R, G, B, and Z are generated. In addition, this RGB/RGBZ conversion section 422A selectively outputs pixel signals D3*r*, D3*g*, and D3*b* corresponding to three colors of R, G, and B among the pixel signals corresponding to the four colors, as an image signal D3. Incidentally, the structure of this RGB/RGBZ conversion section 422A will be described later in detail (FIG. 6).

The BL-level calculation section 423 calculates an emission luminance level per sub-sectional emission area 36, based on the image signal D3 (D3*r*, D3*g*, D3*b*) outputted from the RGB/RGBZ conversion section 422A, and thereby generates the emission pattern signal BL1. Specifically, by analyzing the luminance level of the image signal D3 per sub-sectional emission area 36, an emission pattern corresponding to the luminance level of each area is obtained.

The diffusion section 424 subjects the emission pattern signal BL1 outputted from the BL-level calculation section 423 to predetermined diffusion process, thereby outputting a diffused emission pattern signal BL2 to the LCD-level calculation section 425. Thus, the signal per sub-sectional emission area 36 is converted into the signal per pixel 20. This diffusion processing is performed by considering luminance distribution (diffusion distribution of the light from the light source) in the actual light source (here, the LED of each color) in the backlight 3.

The LCD-level calculation section 425 generates a primary partitioning-drive signal D4 (a pixel signal D4*r* for R, a pixel signal D4*g* for G, and a pixel signal D4*b* for B), based on the image signal D1 (D1*r*, D1*g*, D1*b*) and the diffused emission pattern signal BL2. Specifically, the primary partitioning-drive signal D4 is generated by dividing the signal level of the image signal D1 by the diffused emission pattern signal BL2. To be more specific, the primary partitioning-drive signal D4 is generated by using the following expressions (1) to (3) in the LCD-level calculation section 425.

$$D4r=(D1r/BL2) \quad (1)$$

$$D4g=(D1g/BL2) \quad (2)$$

$$D4b=(D1b/BL2) \quad (3)$$

Here, based on the above expressions (1) to (3), there is obtained such a relation that the primary signal (image signal D1)=(the emission pattern signal BL2×the primary partitioning-drive signal D4). Of this, the physical meaning of (the emission pattern signal BL2×the primary partitioning-drive signal D4) is a superimposing of a picture image of the primary partitioning-drive signal D4 on a picture image of each of the sub-sectional emission areas 36 in the backlight 3 being lighted in a certain emission pattern. As a result, as the details will be described later, the light and shade distribution of the transmitted light in the LCD panel 2 is offset, which results in an equivalence to viewing of the original display (display by the primary signal).

Figure 9:
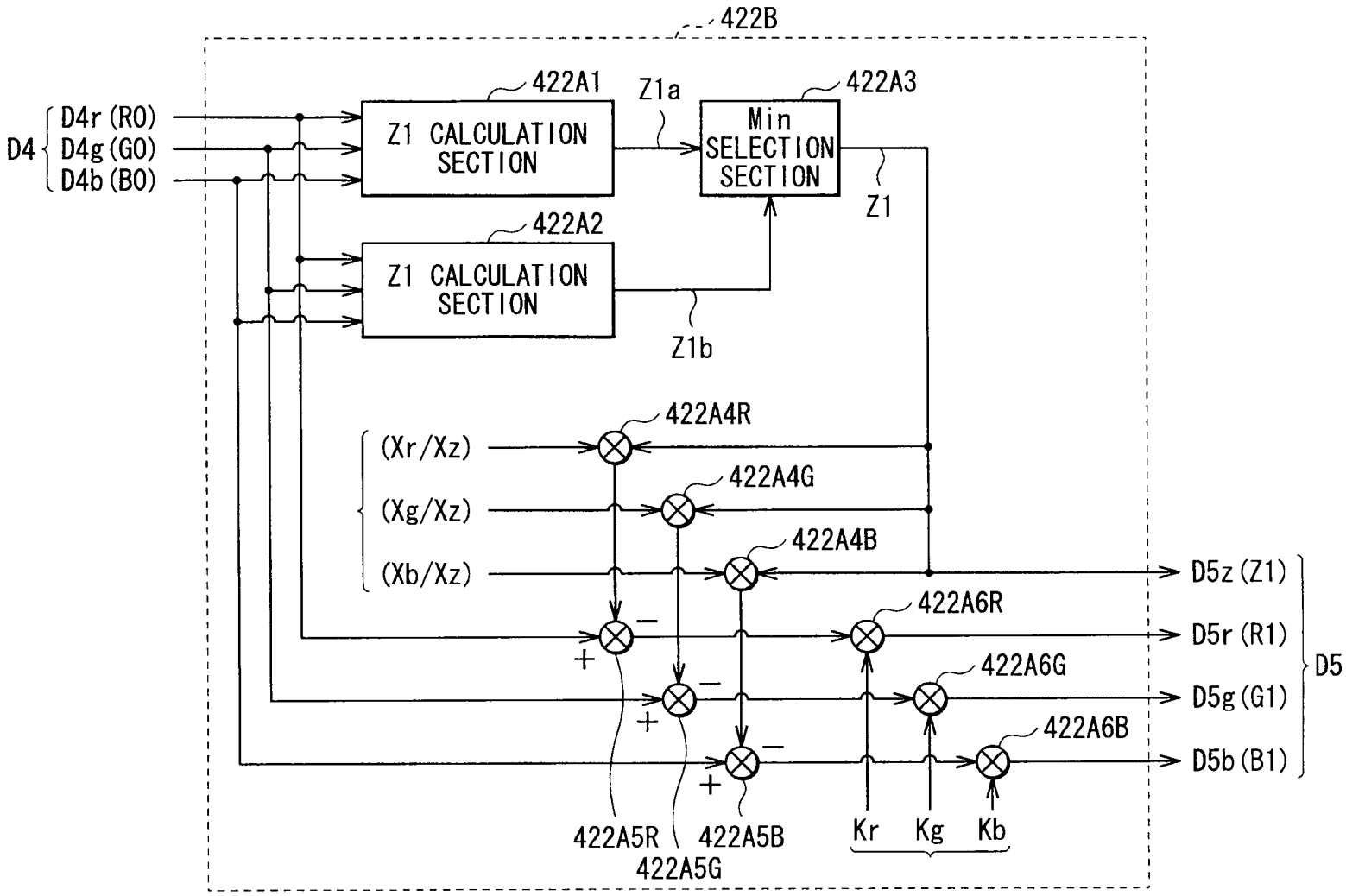
FIG. 9 is a block diagram illustrating a detailed structure of a RGB/RGBZ conversion section 422B illustrated in FIG. 5.

The RGB/RGBZ conversion section 422B subjects the primary partitioning-drive signal D4 (D4*r*, D4*g*, D4*b*) corresponding to three colors of R, G, and B to RGB/RGBZ conversion process (second color conversion process). As a result, a partitioning-drive image signal D5 (D5*r*, D5*g*, D5*b*, D5*z*) corresponding to four colors of R, G, B, and Z is generated. Incidentally, the structure of this RGB/RGBZ conversion section 422B will be described later in detail (FIG. 9).

Here, the characteristics of the operation (the RGB/RGBZ conversion processing) in the RGB/RGBZ conversion sections 422A and 422B to be described below in detail are basically the same. However, the partitioning-drive image signal D5 generated by the RGB/RGBZ conversion section 422B is high-resolution data per pixel 20 (the sub-pixels 20R, 20G, 20B, and 20Z), and is also the data visually observed. For this reason, the performance of the RGB/RGBZ conversion section 422B is desired to be high, and thereby the circuit scale of this RGB/RGBZ conversion section 422B tends to be relatively large. On the other hand, the performance of the RGB/RGBZ conversion section 422A may be lower than that of the RGB/RGBZ conversion section 422B, and the circuit scale may be relatively small, for the following reasons (A) to (C).

(A) The image signal D3 generated by the RGB/RGBZ conversion section 422A is data of low resolution (for example, around 100 units) per sub-sectional emission area 36.

(B) This image signal D3 is used to generate the emission pattern signal BL1 in the BL-level calculation section 423, and is the data that is not visually observed.

(C) By the above-mentioned expressions (1) to (3), in the product of the characteristics of the emission pattern signal BL1 and the primary partitioning-drive signal D4, the light and shade distribution of the transmitted light in the LCD panel 2 is offset, which results in an equivalence to viewing of the original display (display by the primary signal). In other words, in the visual image, an influence on the backlight 3 side is canceled, and becomes irrelevant.

(RGB/RGBZ Conversion Section 422*a*)

FIG. 6 is a block diagram of the RGB/RGBZ conversion section 422A described above. This RGB/RGBZ conversion section 422A has a Z1 calculation section 422A1, a Z1 calculation section 422A2, a Min selection section 422A3, multiplication sections 422A4R, 422A4G, and 422A4B, subtraction sections 422A5R, 422A5G and 422A5B, and multiplication sections 422A6R, 422A6G, and 422A6B. As described above, the RGB/RGBZ conversion section 422A generates the pixel signals corresponding to four colors of R, G, B, and Z, based on the image signal D2 (D2*r*, D2*g*, D2*b*) corresponding to three colors of R, G, and B. Subsequently, among these pixel signals of four colors, the RGB/RGBZ conversion section 422A selectively outputs the pixel signals D3*r*, D3*g*, and D3*b* corresponding to R, G, and B, as the image signal D3. Here, the pixel signals D2*r*, D2*g*, and D2*b* that are input signals will be described as R0, G0, and B0, respectively, the pixel signals D3*b*, D3*g* and D3*b* that are output signals will be described as R1, G1, and, B1, respectively, and the pixel signal corresponding to Z will be described as Z1.

Here, before the description of each block in the RGB/RGBZ conversion section 422A, the reason why the output signal (image signal D3) from this RGB/RGBZ conversion section 422A may not correspond to the four colors of R, G, B, and Z, and may correspond to the three colors of R, G, and B will be described with reference to FIGS. 7A and 7B. In other words, there will be described the reason why an effect of lowering the power consumption by the sub-pixel structure of four colors is obtained even when image display is performed by using the emission pattern signal BL1 generated based on the image signal D3 corresponding to these three colors.

First, the reason for using the sub-pixel structure of four colors including the sub-pixels 20R, 20G, 20B, and 20Z is to lower the power consumption (to improve the luminance efficiency) at the time of image display, by using the high luminance property in the sub-pixel 20Z (exhibiting the luminance higher than that of the sub-pixels 20R, 20G, and 20B). Therefore, when an attempt is made to realize, in the sub-pixel structure of four colors of R, G, B, and Z, the same luminance as that in the case of the sub-pixel structure of three colors of R, G, and B, the luminance level of the image signal for each color becomes lower than that in the case of the sub-pixel structure of three colors. Specifically, for example, as indicated by an arrow in FIG. 7A, the luminance levels of the pixel signals R1, G1, and B1 after the RGB/RGBZ conversion processing become lower than the luminance levels of the pixel signals R0, G0, and B0 before the RGB/RGBZ conversion processing, respectively.

On the other hand, as illustrated in, for example, FIGS. 2A and 2B, in the sub-pixel structure of four colors, because the sub-pixel 20Z is additionally disposed, the area of each of the sub-pixels 20R, 20G, and 20B becomes smaller than that in the case of the sub-pixel structure of three colors. For this reason, when use of the high luminance property in the sub-pixel 20Z is not allowed, the luminance levels of the pixel signals R1, G1, and B1 become higher than the luminance levels of the pixel signals R0, G0, and B0, conversely. FIG. 7B depicts an example of this case, and illustrates the example in which the pixel signals R0, G0, and B0 are red monochrome signals (a luminance level which is effective (not 0) only in the pixel signal R0 exists) when the sub-pixel 20Z is a sub-pixel of white (W). Here, the white (W) is a color expressed when the luminance levels of R, G, and B are the same and therefore, when the pixel signals R0, G0, and B0 are red monochrome signals as mentioned above, lowering the luminance levels of the pixel signals R1, G1, and B1 by using the sub-pixel of white is not allowed. Therefore, in this case, since the area of the sub-pixel 20R is relatively smaller compared to the case of the sub-pixel structure of three colors as described above, the luminance level of the pixel signal R1 is desired to be higher than that of the pixel signal R0, as indicated by an arrow in FIG. 7B, correspondingly.

For these reasons, in the sub-pixel structure of four colors, since the area of each of the sub-pixels 20R, 20G, and 20B becomes small, the luminance levels of the pixel signals R1, G1, and B1 are simply desired to be higher than those of the pixel signals R0, G0, and B1, in order to realize the same luminance as that in the case of the sub-pixel structure of three colors. However, as illustrated in FIG. 7A, in a case where the high luminance property in the sub-pixel 20Z may be used, the luminance levels of the pixel signals R1, G1, and B1 may be lowered by distributing part of the luminance levels of the pixel signals R0, G0, and B0 to the luminance level of the pixel signal Z1. In other words, the luminance levels of the pixel signals R1, G1, B1, and Z1 may be suppressed to be lower than the maximum values of the luminance levels of the pixel signals R0, G0, and B0.

Figure 7A:
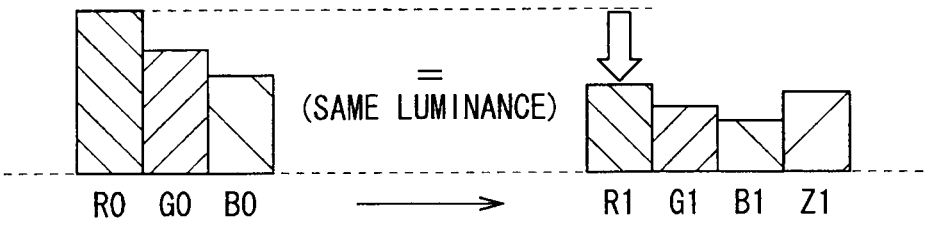
FIG. 7A and FIG. 7B are schematic diagrams for explaining an example of conversion operation in the RGB/RGBZ conversion section.
Figure 7B:
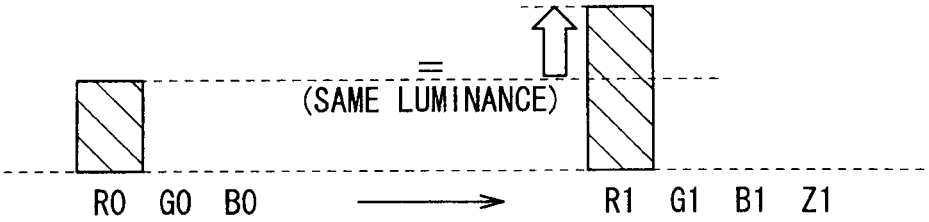

However, when the volume of distribution to the pixel signal Z1 is made too large, in FIG. 7A, for example, the luminance level of the pixel signal Z1 becomes higher than the luminance levels of the pixel signals R1, G1, and B1. Here, in the BL-level calculation section 423, when the emission pattern signal BL1 is generated based on the pixel signals D3*r*, D3*g*, and D3*b* (R1, G1, and B1), the maximum value of the pixel signal in each of the sub-sectional emission areas 36 is often used. Therefore, it is clear that the image signal D3 may be a signal corresponding to three colors of R, G, and B, when the following expression (4) is satisfied, that is, when such a condition that the luminance level of the pixel signal Z1 is lower than those of the pixel signals R1, G1, and B1. In other words, even when image display is performed by using the emission pattern signal BL1 generated based on the image signal D3 corresponding to these three colors, an effect of lowering power consumption by the sub-pixel structure of four colors is obtained.

$$Z1 \leq \mathrm{Max}(R1, G1, B1) \tag{4}$$

Subsequently, with reference to FIGS. 8A and 8B, an expression for computation in the RGB/RGBZ conversion process in the entire RGB/RGBZ conversion section 422A will be described.

Figure 8A:
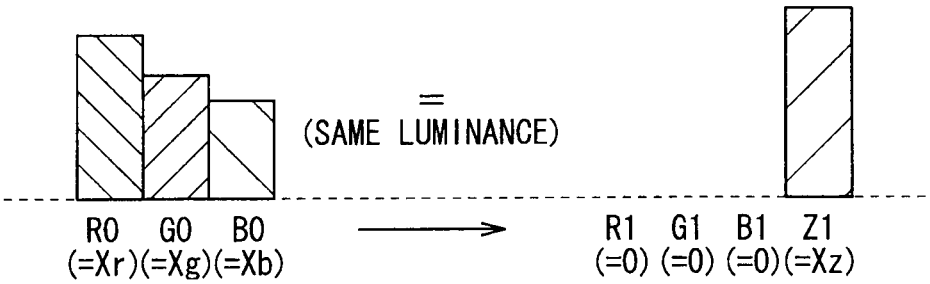
FIG. 8A and FIG. 8B are schematic diagrams for explaining another example of the conversion operation in the RGB/RGBZ conversion section.
Figure 8B:
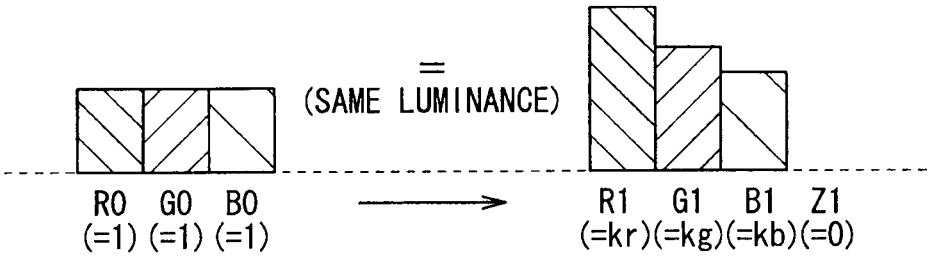

First, as illustrated in FIGS. 8A and 8B, the following relations (expressions (5) and (6)) are assumed to hold between the luminance levels of the pixel signals R0, G0, and B0 before the RGB/RGBZ conversion processing and the luminance levels of the pixel signals R1, G1, B1, and Z1 after the RGB/RGBZ conversion processing. In other words, as illustrated in FIG. 8A, when (R0, G0, B0)=(Xr, Xg, Xb), (R1, G1, B1, Z1)=(0, 0, 0, Xz) holds. In addition, as illustrated in FIG. 8B, when (R0, G0, B0)=(1, 1, 1), (R1, G1, B1, Z1)=(kr, kg, kb, 0) holds. Incidentally, a case where Xr=Xg=Xb is equivalent to a case where the sub-pixel 20Z is the sub-pixel of white (W). Further, when the spectrum in the backlight 3 is the same as that in the case of the sub-pixel structure with three colors of R, G, and B as in the past and also, when the widths (sub-pixel widths) of the sub-pixels 20R, 20G, 20B, and 20Z are equal, kr=kg=kb holds.

$$(R0, G0, B0) = (Xr, Xg, Xb) \Rightarrow (R1, G1, B1, Z1) = (0, 0, 0, Xz) \tag{5}$$

$$(R0, G0, B0) = (1, 1, 1) \Rightarrow (R1, G1, B1, Z1) = (kr, kg, kb0) \tag{6}$$

Here, when expressed by using the above expressions (5) and (6), the luminance levels of the pixel signals R1, G1, and B1 after the RGB/RGBZ conversion processing become values as those in the following expressions (7) to (9). Incidentally, because the luminance levels of the pixel signals R1, G1, and B1 are not allowed to be set as minus (negative) values, a condition of (R1, G1, B1)≥0 is desired in addition to these expressions (7) to (9).

$$\begin{cases} R1 = \left(R0 - \dfrac{X_r}{X_z} Z1\right) k_r \geqq 0 & (7) \\ G1 = \left(G0 - \dfrac{X_g}{X_z} Z1\right) k_g \geqq 0 & (8) \\ B1 = \left(B0 - \dfrac{X_b}{X_z} Z1\right) k_b \geqq 0 & (9) \end{cases}$$

Here, the maximum value of Z1 in a case where all the expressions (7) to (9) mentioned above are satisfied becomes one of candidate values of Z1 that is ultimately generated. When the candidate value in this case is assumed to be Z1*a*, this Z1*a* may be determined by using such a condition that the values in the parentheses in the expressions (7) to (9) are zero or more, and defined by the following expression (10). On the other hand, as indicated by the expression (4) mentioned above, it is desirable to satisfy such a condition that Z1 is smaller than the maximum value among R1, G1, and B1. When the candidate value of Z1 determined based on this condition is assumed to be Z1*b*, this Z1*b* is determined as follows. That is, where Z1*b*=Max (R1, G1, B1) is assumed, Z1*b*=R1 when Max (R1, G1, B1)=R1, Z1*b*=G1 when Max (R1, G1, B1)=G1, and Z1*b*=B1 when Max (R1, G1, B1)=B1. And, when determined by substituting these equations into the expressions (7) to (9) mentioned above, Z1*b* is defined by the following expression (11).

$$\begin{cases} Z1a = \min\left(\dfrac{X_z}{X_r} R0,\ \dfrac{X_z}{X_g} G0,\ \dfrac{X_z}{X_b} B0\right) & (10) \\ Z1b = \max\left(\dfrac{R0}{\left(\dfrac{1}{K_r} + \dfrac{X_r}{X_z}\right)},\ \dfrac{G0}{\left(\dfrac{1}{K_g} + \dfrac{X_g}{X_z}\right)},\ \dfrac{B0}{\left(\dfrac{1}{K_b} + \dfrac{X_b}{X_z}\right)}\right) & (11) \end{cases}$$

Here, in a case where, when Z1*b* determined by the above expression (11) is substituted for Z1 in the expressions (7) to (9), these expressions (7) to (9) hold, Z1*b* at that time is Z1 to be ultimately determined (Z1 optimally distributed). In this case, Z1*b* at that time is a value equal to or smaller than Z1*a* determined by the expression (10).

On the other hand, in a case where, when Z1*b* determined based on the above expression (11) is substituted for Z1 in the expressions (7) to (9), these expressions (7) to (9) do not hold, Z1*a* determined by the above expression (10) is a value smaller than Z1*b* at that time. The reason is because the fact that the expressions (7) to (9) do not hold means any of R1, G1, and B1 is a negative value. Here, as described above, Z1*a* determined by the above expression (10) is a value that makes all of R1, G1, and B1 in the expressions (7) to (9) be positive (plus) values and thus, it is apparent from the expressions (7) to (9) that Z1*a* at that time becomes smaller than Z1*b* determined by the expression (11). However, at this moment, all the values of coefficients kr, kg, and kb in the expressions (7) to (9) are assumed to be positive. It is clear from the foregoing that at the time of the RGB/RGBZ conversion processing, either Z1*a* determined by the expression (10) or Z1*b* determined by the expression (11), whichever is smaller in value, may be selected as the ultimate Z1.

Next, with reference to FIG. 6 again, based on the above description, each block in the RGB/RGBZ conversion section 422A will be described.

The Z1 calculation section 422A1 calculates Z1*a* which is a candidate value of Z1, by using the expression (10), based on the pixel signals D2*r*, D2*g*, and D2*b* (R0, G0, B0).

The Z1 calculation section 422A2 calculates Z1*b* which is a candidate value of Z1, by using the expression (11), based on the pixel signals D2*r*, D2*g*, and D2*b* (R0, G0, B0).

The Min selection section 422A3 selects either Z1*a* outputted from the Z1 calculation section 422A1 or Z1*b* outputted from the Z1 calculation section 422A2, whichever is smaller in value, and outputs the selected one as the ultimate Z1.

The multiplication section 422A4R multiplies Z1 outputted from the Min selection section 422A3 by a predetermined constant (Xr/Xz), and outputs the result. The multiplication section 422A4G multiplies Z1 outputted from the Min selection section 422A3 by a predetermined constant (Xg/Xz), and outputs the result. The multiplication section 422A4B multiplies Z1 outputted from the Min selection section 422A3 by a predetermined constant (Xb/Xz), and outputs the result.

The subtraction section 422A5R subtracts the value (multiplied value) outputted by the multiplication section 422A4R from the pixel signal D2*r* (R0), and outputs the result. The subtraction section 422A5G subtracts the value (multiplied value) outputted by the multiplication section 422A4G from the pixel signal D2*g* (G0), and outputs the result. The subtraction section 422A5B subtracts the value (multiplied value) outputted by the multiplication section 422A4B from the pixel signal D2*b* (B0), and outputs the result.

The multiplication section 422A6R multiplies the value (subtracted value) outputted from the subtraction section 422A5R by a predetermined constant kr, and outputs the result as the pixel signal D3*r* (R1). The multiplication section 422A6G multiplies the value (subtracted value) outputted from the subtraction section 422A5G by a predetermined constant kg, and outputs the result as the pixel signal D3*g* (G1). The multiplication section 422A6B multiplies the value (subtracted value) outputted from the subtraction section 422A5B by a predetermined constant kb, and outputs the result as the pixel signal D3*b* (B1).

(RGB/RGBZ Conversion Section 422B)

FIG. 9 is a block diagram of the RGB/RGBZ conversion section 422B. As described above, this RGB/RGBZ conversion section 422B subjects the primary partitioning-drive signal D4 (D4*r*, D4*g*, D4*b*) for R, G, and B to the RGB/RGBZ conversion process, thereby generating the partitioning-drive image signal D5 (D5*r*, D5*g*, D5*b*, D5*z*) for R, G, B, and Z. Therefore, the block configuration of the RGB/RGBZ conversion section 422B is similar to that of the RGB/RGBZ conversion section 422A, except for also outputting the calculated Z1 as the pixel signal D5*z*. In other words, the RGB/RGBZ conversion section 422B has the Z1 calculation section 422A1, the Z1 calculation section 422A2, the Min selection section 422A3, the multiplication sections 422A4R, 422A4G, and 422A4B, the subtraction sections 422A5R, 422A5G, and 422A5B, and the multiplication sections 422A6R, 422A6G, and 422A6B.

[Operation and Effect of Liquid Crystal Display 1]

Subsequently, there will be described the operation and effect of the LCD 1 of the present embodiment.

(1. Summary of Sub-Sectional Emission Operation)

In this LCD 1, as illustrated in FIG. 1, at first, the image-signal processing section 41 generates the image signal D1 (D1*r*, D1*g*, D1*b*) by subjecting the input image signal Din to the predetermined image process. Subsequently, the partitioning-drive processing section 42 subjects this image signal D1 to the predetermined partitioning-drive process. As a result, each of the emission pattern signal BL1 indicating the emission pattern on the partial sub-sectional emission area 36 basis in the backlight 3 and the partitioning-drive image signal D5 (D5*r*, D5*g*, D5*b*, D5*z*) is generated.

Subsequently, each of the partitioning-drive image signal D5 and the emission pattern signal BL1 generated in this way is inputted into the timing control section 43. Of these, the partitioning-drive image signal D5 is supplied from the timing control section 43 to the data driver 51. The data driver 51 subjects this partitioning-drive image signal D5 to the D/A conversion, thereby generating the image voltage that is an analog signal. Then, the display driving operation is performed by the drive voltage outputted from each of the data driver 51 and the gate driver 52 to each of the pixels 20 (each of the sub-pixels 20R, 20G, 20B, and 20Z). As a result, the display driving based on the partitioning-drive image signal D5 (D5*r*, D5*g*, D5*b*, D5*z*) is performed for each of the pixels 20 (each of the sub-pixels 20R, 20G, 20B, and 20Z) in the LCD panel 2.

Specifically, as illustrated in FIG. 3, according to a selection signal supplied from the gate driver 52 through the gate line G, on-off operation of the TFT element 21 is switched. As a result, conduction of the data line D or conduction of the liquid crystal element 22 as well as the auxiliary capacitive element 23 is selected. As a result, the image voltage based on the partitioning-drive image signal D5 supplied from the data driver 51 is supplied to the liquid crystal element 22, and the line-sequential display driving operation is performed.

On the other hand, the emission pattern signal BL1 is supplied from the timing control section 43 to the backlight driving section 50. The backlight driving section 50 performs the emission driving (partitioning-driving operation) for each of the plurality of sub-sectional emission areas 36 in the backlight 3, based on this emission pattern signal BL1.

At this moment, in the pixel 20 to which the image voltage is supplied, illumination light from the backlight 3 is modulated in the 1 LCD panel 2, and emitted as display light. As a result, the image display based on the input image signal Din is performed in the LCD 1.

Figure 10:
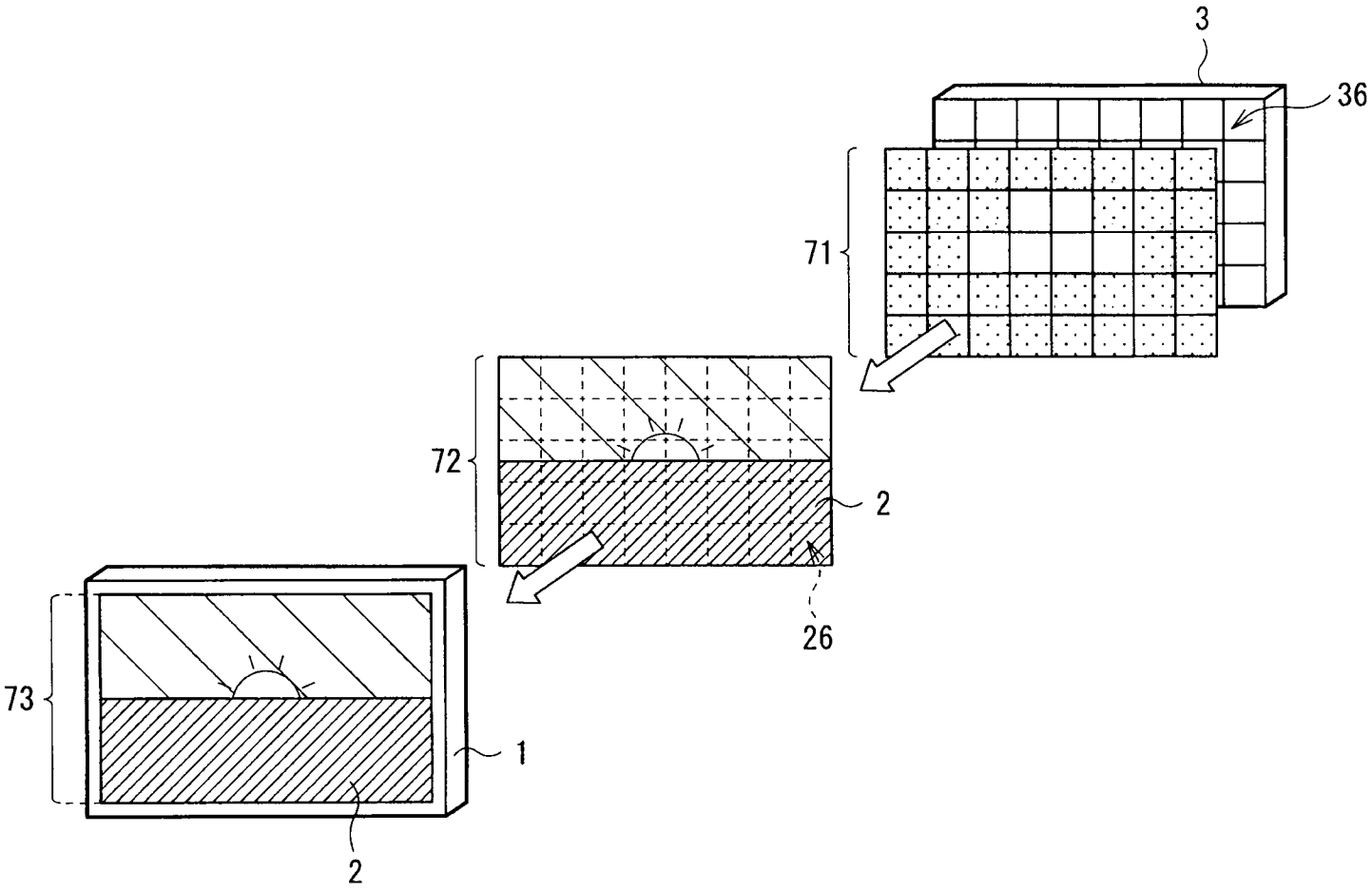
FIG. 10 is a schematic diagram illustrating an outline of sub-sectional emission operation of a backlight in the LCD illustrated in FIG. 1.
Figure 11:
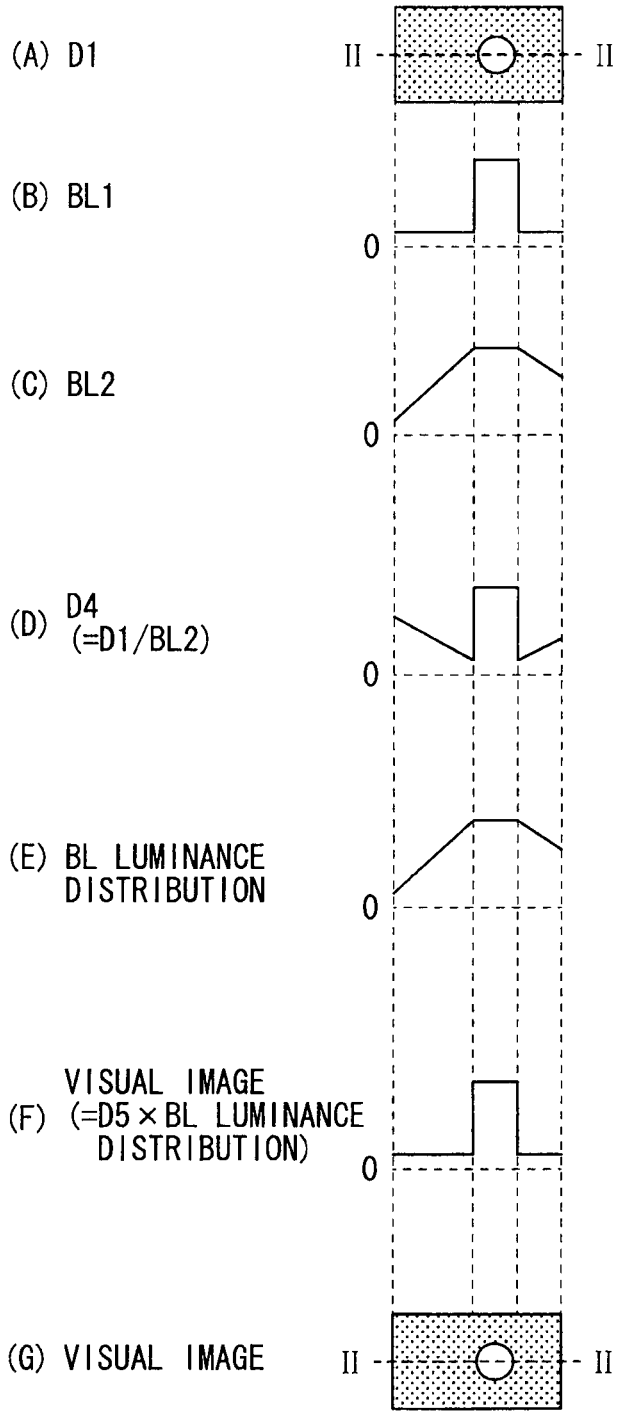
FIGS. 11A to 11G are schematic waveform diagrams for explaining an outline of the sub-sectional emission operation of the backlight in the LCD illustrated in FIG. 1.

Specifically, as illustrated in FIG. 10, for example, a synthetic image 73 (superimposed based on multiplication), which is obtained by physically superimposing a panel-surface image 72 by the display panel 2 alone on a emitting surface image 71 by each sub-sectional emission area 36 of the backlight 3, becomes an image to be ultimately observed in the entire LCD 1.

In addition, when the image signal D1 inputted into the partitioning-drive processing section 42 represents such a still image that a small bright object is present in a background that is dark as a whole (of gray level), the sub-sectional emission operation will be as follows.

FIGS. 11A to 11G schematically illustrate the sub-sectional emission operation in the LCD 1 in this case, in a timing diagram. In this FIGS. 11A to 11D indicate the image signal D1, the emission pattern signal BL1, the emission pattern signal BL2, and the primary partitioning-drive signal D4 (=D1/BL2), respectively. In addition, FIG. 11E indicates actual luminance distribution (BL luminance distribution) in the backlight 3, and FIGS. 11F and 11G indicate actual visual images (=D5×BL luminance distribution). Incidentally, in FIGS. 11B to 11F, the horizontal axis indicates the pixel position in a horizontal direction along a line II-II in FIGS. 11A and 11G. Further, in FIGS. 11A and 11G, the vertical axis indicates the pixel position in a vertical (perpendicular) direction of the screen, and in FIGS. 11B to 11F, the vertical axis indicates a level axis. From these FIGS. 11A to 11G, it is clear that at the time of image display using the sub-sectional emission operation, the contents (image) of the input image signal D1 and the visual image correspond with each other.

(2. Sub-Sectional Emission Operation Adapted to Image Display Using RGB/RGBZ Conversion Process)

Next, the sub-sectional emission operation adapted to image display using the RGB/RGBZ conversion process, which is one of features of the embodiments of the present disclosure, will be described in detail in comparison with comparative examples (comparative examples 1 and 2).

2-1. Comparative Example 1

Figure 12:
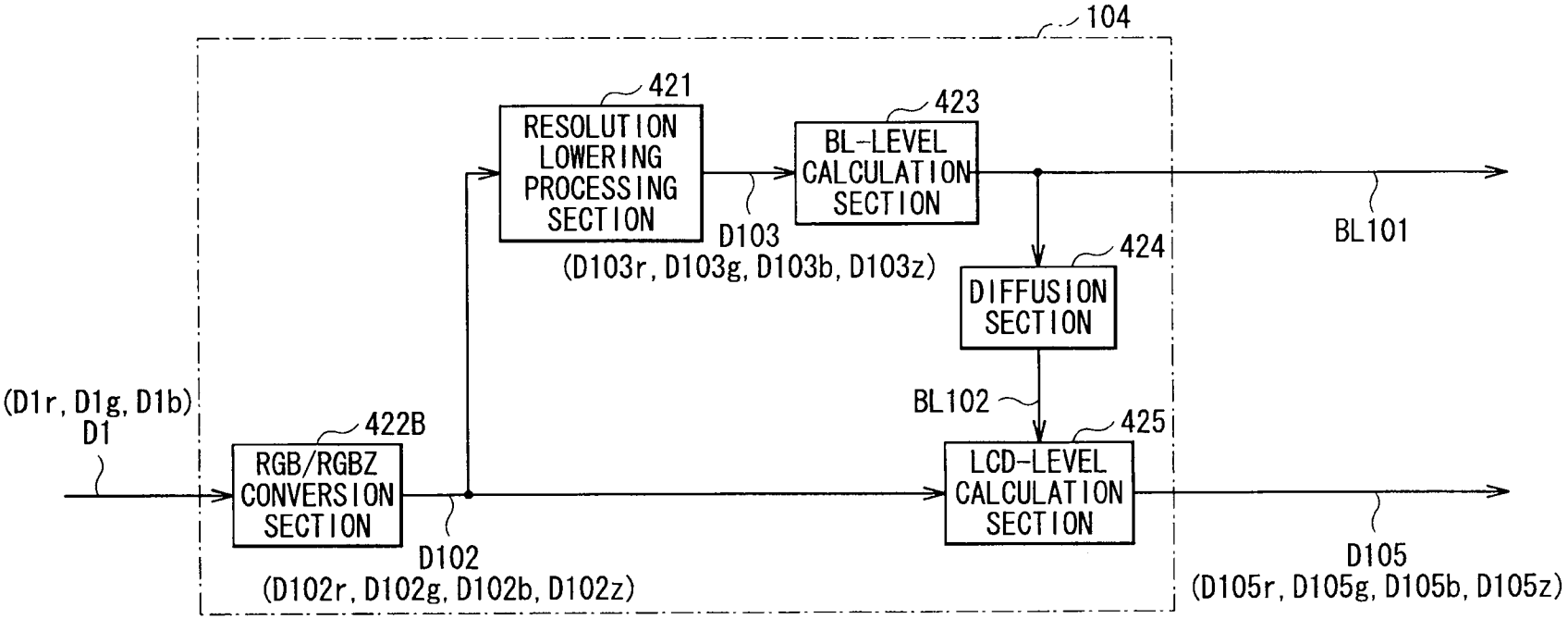
FIG. 12 is a block diagram illustrating a structure of a partitioning-drive processing section in a LCD according to a comparative example 1.

FIG. 12 is a block diagram of a partitioning-drive processing section (partitioning-drive processing section 104) in a LCD according to the comparative example 1. The partitioning-drive processing section 104 of this comparative example 1 is configured in a manner similar to the partitioning-drive processing section 42 of the present embodiment illustrated in FIG. 5, except that the RGB/RGBZ conversion section 422A is omitted (not provided), and the position where the RGB/RGBZ conversion section 422B is provided is changed. Specifically, the position where the RGB/RGBZ conversion section 422B is provided is in the foremost stage within the partitioning-drive processing section 104 (in a stage before the resolution-lowering processing section 421 and the LCD-level calculation section 425).

In this partitioning-drive processing section 104, at first, in the RGB/RGBZ conversion section 422B, the image signal D1 is subjected to the RGB/RGBZ conversion processing in a manner similar to the present embodiment. As a result, an image signal D102 (a pixel signal D102*r* for R, a pixel signal D102*g* for G, a pixel signal D102*b* for B, and a pixel signal D102*z* for Z) after such RGB/RGBZ conversion process is generated. Subsequently, the resolution-lowering processing section 421 subjects this image signal D102 to the resolution-lowering process, thereby generating an image signal D103 (a pixel signal D103*r* for R, a pixel signal D103*g* for G, a pixel signal D103*b* for B, and a pixel signal D103*z* for Z). Then, based on this image signal D103, the BL-level calculation section 423 generates an emission pattern signal BL101 indicating the emission pattern on the sub-sectional emission area 36 basis. Further, in the diffusion section 424, the emission pattern signal BL101 outputted from the BL-level calculation section 423 is subjected to the diffusion process, and a diffused emission pattern signal BL102 is outputted to the LCD-level calculation section 425. Subsequently, based on the image signal D102 after the RGB/RGBZ conversion process and the diffused emission pattern signal BL102, both described above, the LCD-level calculation section 425 generates a partitioning-drive image signal D105 (a pixel signal D105*r* for R, a pixel signal D105*g* for G, a pixel signal D105*b* for B, and a pixel signal D105*z* for Z). Specifically, the LCD-level calculation section 425 generates the image signal D105, by using the following expressions (12) to (14) in a manner similar to the present embodiment.

$$D105r=(D102r/BL102) \tag{12}$$

$$D105g=(D102g/BL102) \tag{13}$$

$$D105b=(D102b/BL102) \tag{14}$$

In this way, in the partitioning-drive processing section 104 of this comparative example 1, at first, the image signal D1 corresponding to three colors of R, G, and B is subjected to the RGB/RGBZ conversion process, and thereby the image signal D102 corresponding to four colors of R, G, B, and Z is generated. Subsequently, based on this image signal D2 corresponding to four colors, each of the emission pattern signal BL101 and the partitioning-drive image signal D105 corresponding to four colors is generated. Therefore, with the partitioning-drive processing section 104, as compared to a case where the emission pattern signal and the partitioning-drive image signal are generated by using the image signal D1 for three colors of R, G, and B as it is, the circuit scale and the like increase and thus it is difficult to achieve a reduction in size. Specifically, the circuit scales and the like of the resolution-lowering processing section 421, the BL-level calculation section 423, the diffusion section 424, and the LCD-level calculation section 425 increase. In other words, power consumption lower than before is achieved by combining the sub-pixel structure of four colors of R, G, B, and Z with the sub-sectional emission operation, but it is difficult to achieve a reduction in cost.

2-2. Comparative Example 2

Figure 13:
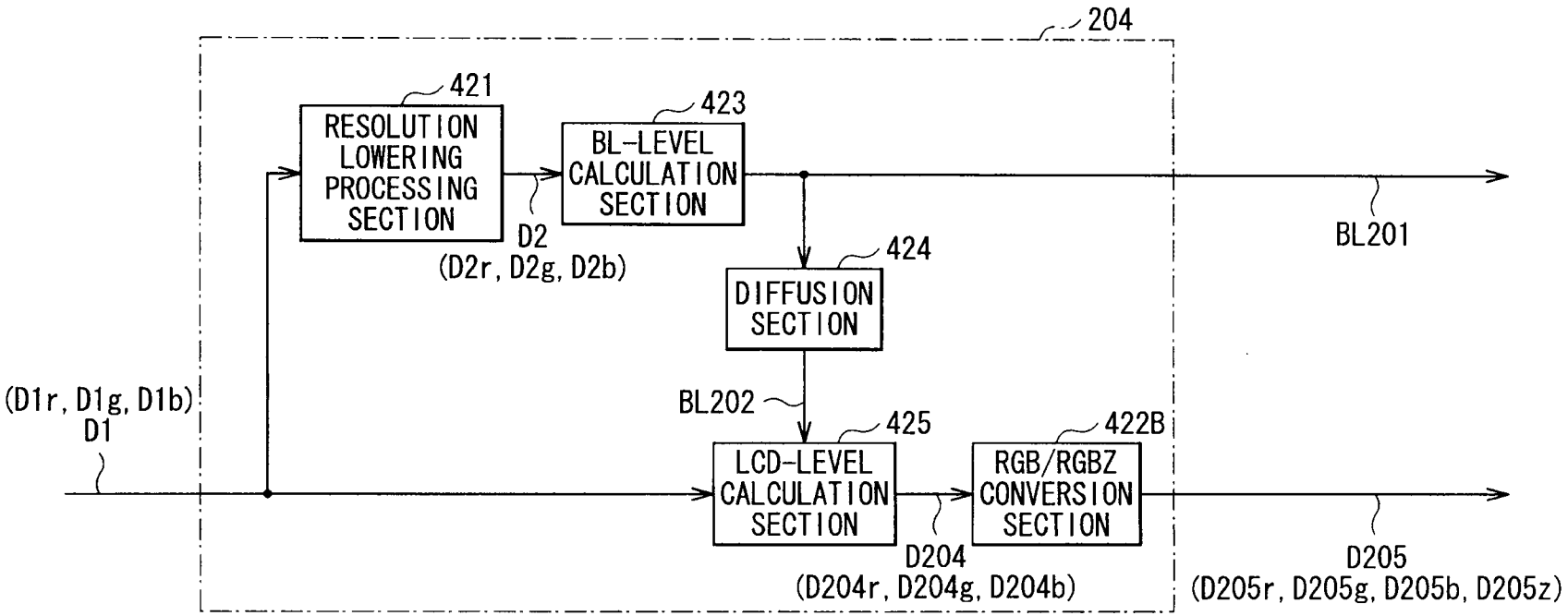
FIG. 13 is a block diagram illustrating a structure of a partitioning-drive processing section in a LCD according to a comparative example 2.

Meanwhile, FIG. 13 is a block diagram of a partitioning-drive processing section (partitioning-drive processing section 204) in a LCD according to the comparative example 2. This partitioning-drive processing section 204 of the comparative example 2 is configured in a manner similar to the partitioning-drive processing section 42 of the present embodiment illustrated in FIG. 5, except that the RGB/RGBZ conversion section 422A is omitted (not provided).

In this partitioning-drive processing section 204, at first, in the resolution-lowering processing section 421, the image signal D1 is subjected to the resolution-lowering process, and thereby the image signal D2 is generated, in a manner similar to the present embodiment. Subsequently, based on this image signal D2, the BL-level calculation section 423 generates an emission pattern signal BL201. Further, in the diffusion section 424, the emission pattern signal BL201 is subjected to the diffusion process, and an diffused emission pattern signal BL202 is outputted to the LCD-level calculation section 425. On the other hand, based on the image signal D1 and the diffused emission pattern signal BL202, the LCD-level calculation section 425 generates an image signal D204 (a pixel signal D204*r* for R, a pixel signal D204*g* for G, and a pixel signal D204*b* for B). Specifically, the LCD-level calculation section 425 generates the image signal D204 by using the following expressions (15) to (17), in a manner similar to the present embodiment. Subsequently, the RGB/RGBZ conversion section 422B subjects the thus generated image signal D204 to the RGB/RGBZ conversion process, in a manner similar to the present embodiment. As a result, a partitioning-drive image signal D205 (a pixel signal D205*r* for R, a pixel signal D205*g* for G, a pixel signal D205*b* for B, and a pixel signal D205*z* for Z) is generated.

$$D204r=(D1r/BL202) \tag{15}$$

$$D204g=(D1g/BL202) \tag{16}$$

$$D204b=(D1b/BL202) \tag{17}$$

In this way, in the partitioning-drive processing section 204 of this comparative example 2, in a manner opposite to the comparative example 1, at first, each of the emission pattern signal BL201 and the image signal D204 for partitioning-drive, which correspond to three colors of R, G, and B is generated, based on the image signal D1 corresponding to three colors of R, G, and B as in the past. Subsequently, this image signal D204 corresponding to the three colors is subjected to the RGB/RGBZ conversion process, and thereby the partitioning-drive image signal D205 corresponding to four colors of R, G, B, and Z is generated. In this partitioning-drive processing section 204, the emission pattern signal BL201 and the partitioning-drive image signal corresponding to the three colors are generated by using the image signal D1 corresponding to the three colors as it is and therefore, unlike the above-described comparative example 1, an increase in the circuit scale and the like is not caused. In other words, as compared to those in the past, there is no increase in the circuit scales and the like of the resolution-lowering processing section 421, the BL-level calculation section 423, the diffusion section 424, and the LCD-level calculation section 425 (those in the past may be used as they are). The partitioning-drive image signal D205 corresponds to the sub-pixel structure of the four colors and thus, the signal level of this partitioning-drive image signal D205 may be reduced. Therefore, the power consumption may also be reduced to some extent, as compared to the case of image display by the sub-pixel structure of the three colors in the past.

However, in this comparative example 2, the emission pattern signal BL201 is generated by using the image signal D1 corresponding to three colors of R, G, and B as it is. In other words, the emission pattern signal BL201 corresponds to the three colors. For this reason, as compared to the case, like the comparative example 1, for example, where the emission pattern signal generated based on the image signal (pixel signals) corresponding to four colors of R, G, B, and Z is used, luminance efficiency at the time of image display is not sufficient, and lowering the power consumption is not sufficient as well. In other words, with this comparative example 2, a reduction in size may be realized and thereby the cost may be reduced, but it is difficult to lower the power consumption.

2-3. Sub-Sectional Emission Operation of the Embodiment

In contrast, in the present embodiment, the RGB/RGBZ conversion process is performed based on the image signal D1 corresponding to three colors of R, G, and B in the partitioning-drive processing section 42 and thereby, the pixel signals D3*r*, D3*g*, D3*b*, and Z1 corresponding to four colors of R, G, B, and Z are generated. And, based on the pixel signals D3*r*, D3*g*, and D3*b* corresponding to three colors of R, G, and B among these pixel signals corresponding to four colors, the light-emission-pattern signal BL1 is generated. As a result, as compared to the case where the emission pattern signal is generated by using the image signals corresponding to the four colors, like the comparative example 1, a part that generates the emission pattern signal (here, the resolution-lowering processing section 421 and the BL-level calculation section 423) is reduced in size. In other words, as compared to those in the past, the circuit scales and the like of the resolution-lowering processing section 421 and the BL-level calculation section 423 do not increase (those in the past may be used as they are). In addition, the emission pattern signal BL1 is generated by using part (the pixel signals D3*r*, D3*g*, and D3*b* corresponding to the three colors) of the pixel signals corresponding to the four colors obtained by performing the RGB/RGBZ conversion processing to generate the pixel signal Z1 corresponding to the color (Z) with luminance higher than those of the three colors. For this reason, as compared to the case where the emission pattern signal is generated without performing the RGB/RGBZ conversion process like the comparative example 2, display luminance is maintained while the signal level is reduced.

In addition, in the present embodiment, the partitioning-drive original signal D4 corresponding to three colors of R, G, and B is generated based on the image signal D1 corresponding to the three colors and the emission pattern signal BL1, described above, in the partitioning-drive processing section 42. Then, the primary partitioning-drive signal D4 corresponding to the three colors is subjected to the RGB/RGBZ conversion process and thereby, the partitioning-drive image signal D5 corresponding to four colors of R, G, B, and Z is generated. As a result, as compared to the case where the image signal D1 is subjected to the RGB/RGBZ conversion process and thereby the pixel signals corresponding to the four colors is generated and then the partitioning-drive image signal is generated by using the pixel signals corresponding to the four colors, like the comparative example 1, a part that generates the partitioning-drive image signal may be reduced in size. Specifically, here, the sizes of the diffusion section 424 and the LCD-level calculation section 425 are reduced. In other words, as compared to those in the past, the partitioning-drive with the sub-pixel structure of the four colors is realized without increasing the circuit scales and the like of the diffusion section 424 and the LCD-level calculation section 425 (those in the past may be used as they are).

As described above, according to the present embodiment, in the partitioning-drive processing section 42, the RGB/RGBZ conversion processing is performed based on the image signal D1 corresponding to three colors of R, G, and B and thereby, after the pixel signals D3*r*, D3*g*, D3*b*, and Z1 corresponding to four colors of R, G, B, and Z are generated, the emission pattern signal BL1 is generated based on the pixel signals D3*r*, D3*g*, and D3*b* corresponding to the three colors among these pixel signals corresponding to the four colors. Therefore, the part that generates the emission pattern signal BL1 may be reduced in size, and the display luminance is maintained while the signal level is reduced. In addition, the primary partitioning-drive signal D4 corresponding to the three colors is generated based on the image signal D1 and the emission pattern signal BL1 and then, the primary partitioning-drive signal D4 corresponding to the three colors is subjected to the RGB/RGBZ conversion process and thereby, the partitioning-drive image signal D5 corresponding to the four colors of is generated. Therefore, the part that generates the partitioning-drive image signal D5 may be reduced in size. Accordingly, at the time of image display using the light source section performing the sub-sectional emission operation, compatibility between a reduction in cost and a reduction in power consumption may be realized. Further, by performing the sub-sectional emission, a reduction in power consumption and improvement of black luminance similar to those in the sub-sectional emission operation in the past may be achieved. Furthermore, as the resolution-lowering processing section 421, the BL-level calculation section 423, the diffusion section 424, and the LCD-level calculation section 425, those available in the past may be used as they are and therefore, efficient development of products may be carried out.

Moreover, in the partitioning-drive processing section 42, the image signal D1 corresponding to three colors of R, G, and B is subjected to the predetermined resolution-lowering process and thereby the image signal D2 (resolution-lowered signal) corresponding to the three colors is generated and then, this image signal D2 is subjected to the RGB/RGBZ conversion process and thereby the pixel signals corresponding to four colors of R, G, B, and Z are generated. Therefore, the image signal whose resolution is lowered may be subjected to the RGB/RGBZ conversion process and thus, an increase in circuit scale and the like may be suppressed, as compared to the case where the image signal D1 before its resolution is lowered is subjected to the RGB/RGBZ conversion process.

Second Embodiment

Next, the second embodiment of the present disclosure will be described. Incidentally, the same elements as those in the first embodiment will be provided with the same reference characters as those of the first embodiment.

[Entire Structure of LCD 1A]

Figure 14:
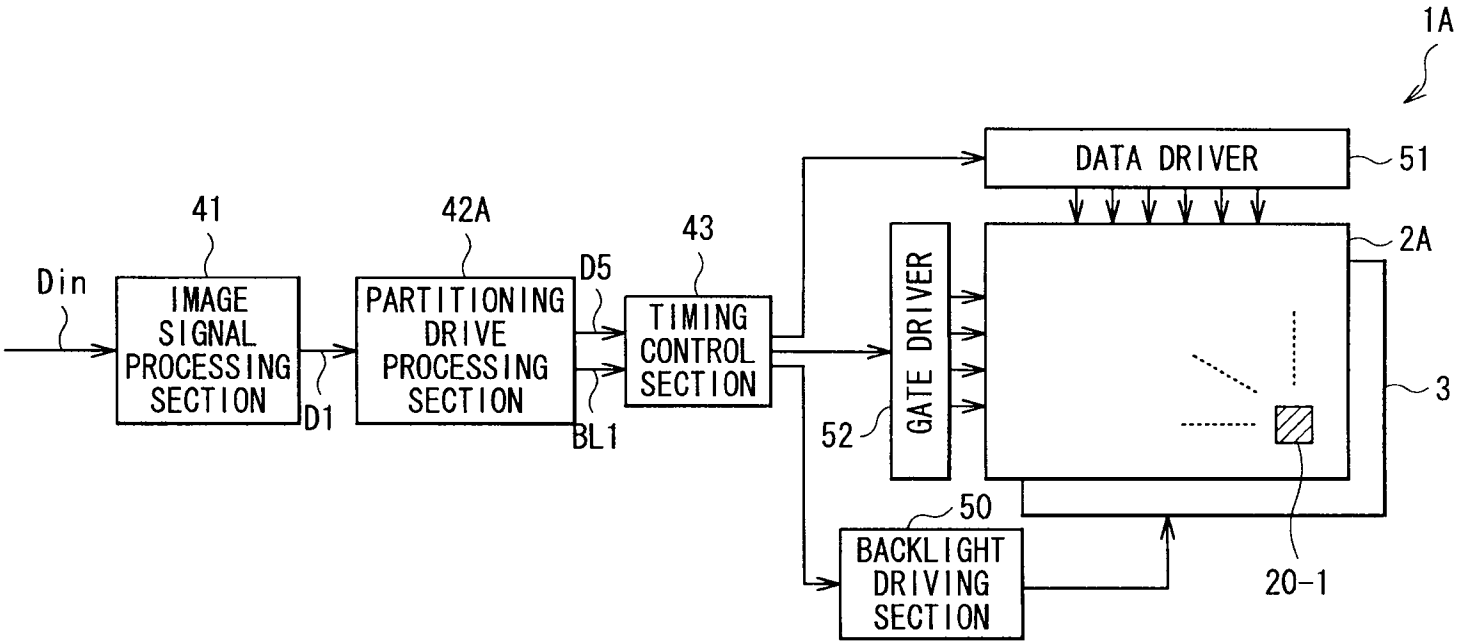
FIG. 14 is a block diagram illustrating the entire structure of a LCD according to a second embodiment of the present disclosure.

FIG. 14 is a block diagram of the entire LCD (LCD 1A) according to the present embodiment. This LCD 1A is provided with a LCD panel 2A having pixels 20-1 in place of the LCD panel 2 having the pixels 20, and a partitioning-drive processing section 42A in place of the partitioning-drive processing section 42, in the LCD 1 of the first embodiment.

Figure 15A:
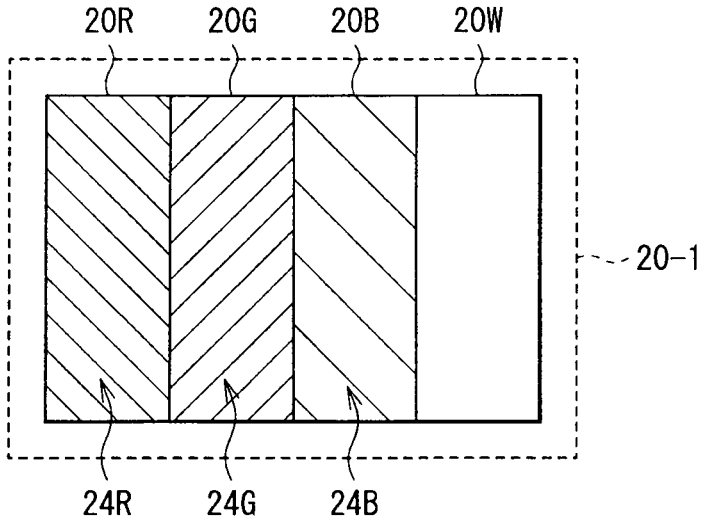
FIG. 15A and FIG. 15B are plan views each schematically illustrating an example of the sub-pixel structure of a pixel illustrated in FIG. 14.
Figure 15B:
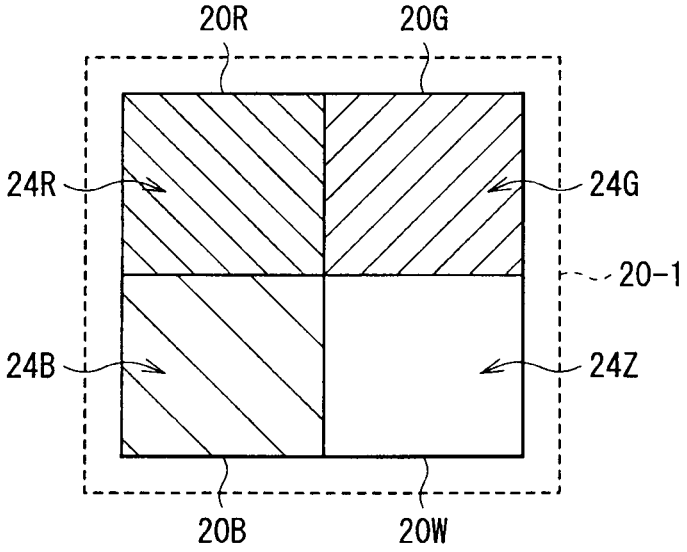

FIGS. 15A and 15B each illustrate an example of the structure of sub-pixels in each of the pixels 20-1 of the LCD panel 2A in a schematic plan view, and correspond to FIGS. 2A and 2B in the first embodiment, respectively. As in the first embodiment, each of the pixels 20-1 includes sub-pixels 20R, 20G, and 20B corresponding to three colors of R, G, and B and a sub-pixel 20W of a color white (W) with luminance higher than those of the three colors. In other words, the pixel 20-1 of the present embodiment includes the sub-pixel 20W corresponding to W, as an example of the sub-pixel 20Z described in the first embodiment. In the sub-pixels 20R, 20G, and 20B corresponding to three colors of R, G, and B, color filters 24R, 24G, and 24B corresponding to the three colors are disposed like the first embodiment. On the other hand, in the sub-pixel 20W for W, no color filter is disposed and thereby, high luminance may be exhibited (luminance efficiency may be improved).

[Detailed Structure of Partitioning-Drive Processing Section 42A]

Figure 16:
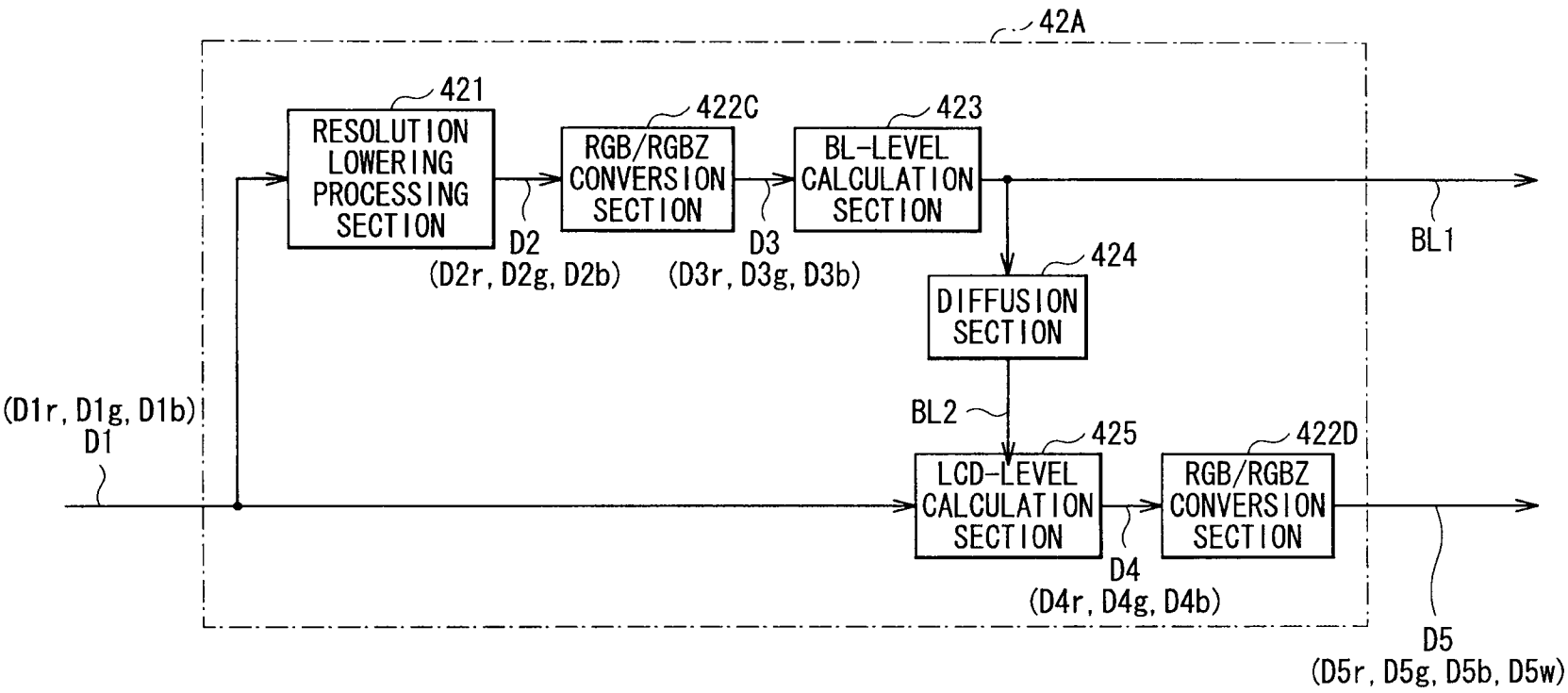
FIG. 16 is a block diagram illustrating a detailed structure of a partitioning-drive processing section illustrated in FIG. 14.

FIG. 16 is a block diagram of the partitioning-drive processing section 42A. This partitioning-drive processing section 42A is provided with a RGB/RGBW conversion section 422C in place of the RGB/RGBZ conversion section 422A, and a RGB/RGBW conversion section 422D in place of the RGB/RGBZ conversion section 422B, in the partitioning-drive processing section 42 of the first embodiment.

(RGB/RGBW Conversion Section 422C)

The RGB/RGBW conversion section 422C subjects an image signal D2 (D2*r*, D2*g*, D2*b*) corresponding to three colors of R, G, and B to RGB/RGBW conversion process (first color conversion process), thereby generating pixel signals corresponding to four colors of R, G, B, and W. Subsequently, the RGB/RGBW conversion section 422C selectively outputs pixel signals D3*r*, D3*g*, and D3*b* corresponding to the three colors among these pixel signals of the four colors, as an image signal D3.

Figure 17:
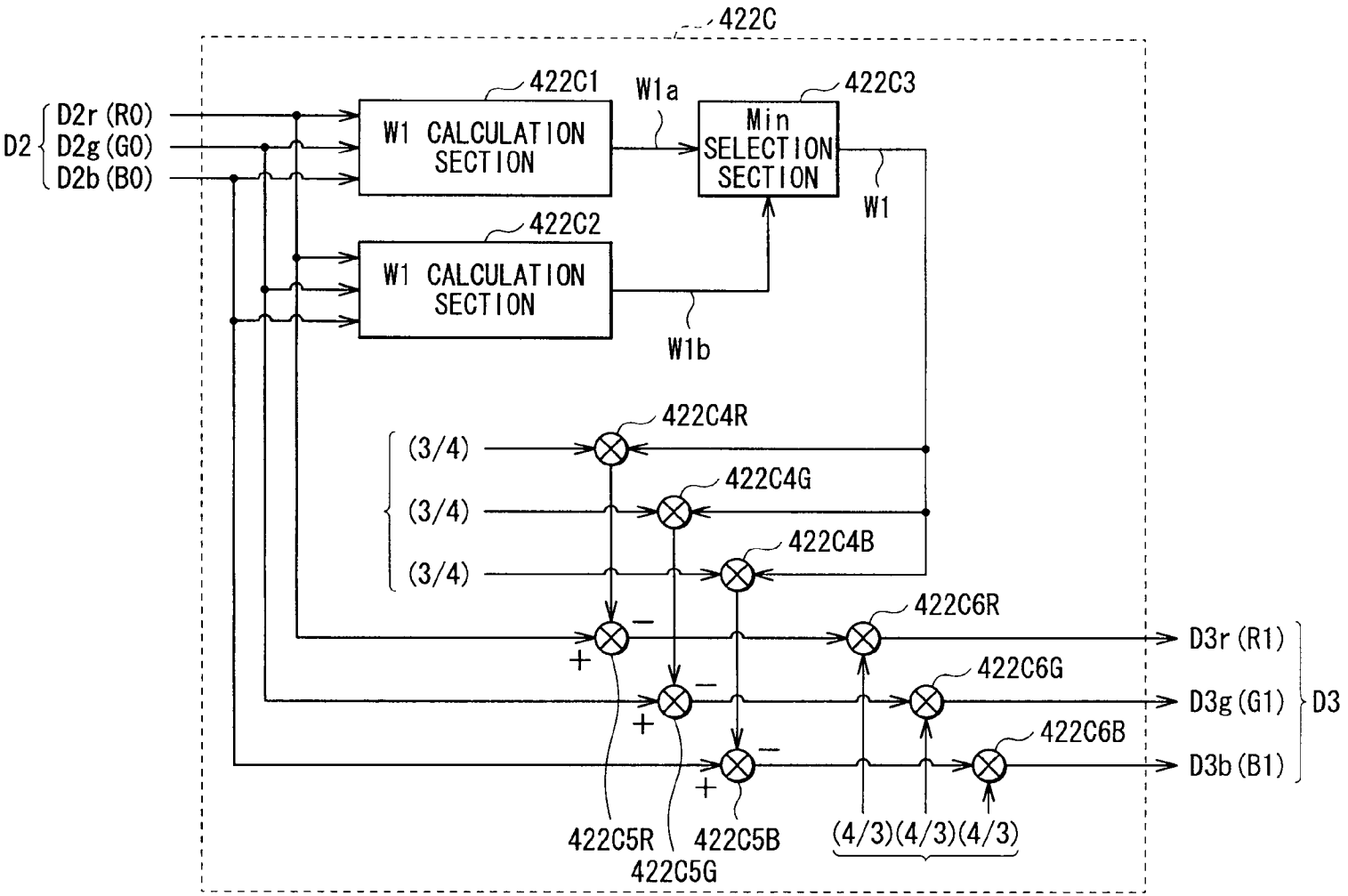
FIG. 17 is a block diagram illustrating a detailed structure of a RGB/RGBW conversion section 422C illustrated in FIG. 16.

FIG. 17 is a block diagram of this RGB/RGBW conversion section 422C. The RGB/RGBW conversion section 422C includes a W1 calculation section 422C1, a W1 calculation section 422C2, a Min selection section 422C3, multiplication sections 422C4R, 422C4G, and 422C4B, subtraction sections 422C5R, 422C5G, and 422C5B, and multiplication sections 422C6R, 422C6G, and 422C6B. Here, the pixel signals D2*r*, D2*g*, and D2*b*, which are input signals, will be described as R0, G0, and B0, respectively, the pixel signals D3*r*, D3*g*, and D3*b*, which are output signals, will be described as R1, G1, and B1, respectively, and a pixel signal corresponding to W will be described as W1.

Figure 18A:
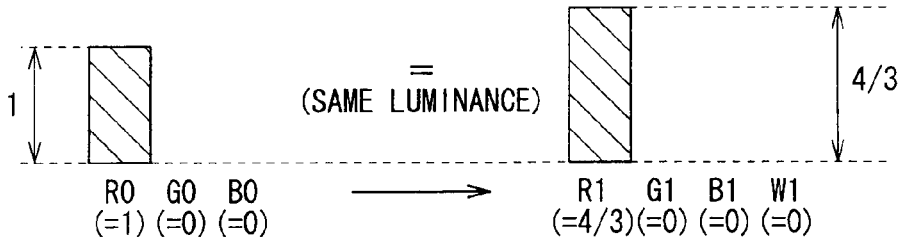
FIGS. 18A to 18C are schematic diagrams for explaining an example of the conversion operation in the RGB/RGBW conversion section.
Figure 18B:
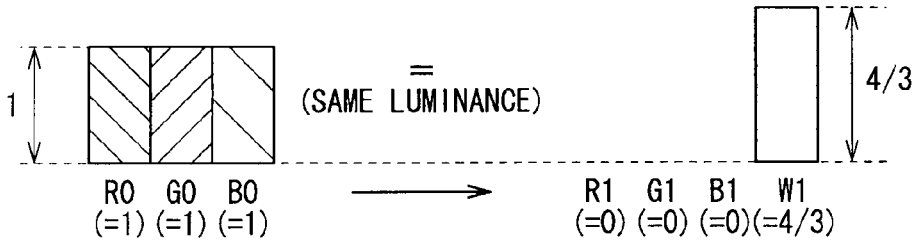

Here, before the description of each block in this RGB/RGBW conversion section 422C, a computation expression in the RGB/RGBW conversion process in the entire RGB/RGBW conversion section 422C will be described with reference to FIGS. 18A to 18C. Incidentally, the computation expression in this RGB/RGBW conversion process is basically similar to that in the RGB/RGBZ conversion process described for the first embodiment.

Firstly, the width (sub-pixel width) of each of the sub-pixels 20R, 20G, 20B, and 20W is a quarter of the width (pixel width) of the pixel 20-1. Therefore, as compared to the case of the sub-pixel structure for three colors of R, G, and B (the width of each sub-pixel is one-third of the pixel width), the area of the sub-pixels 20R, 20G, 20B, and 20W is reduced to three-quarters. For this reason, when the same luminance level as that in the case of the sub-pixel structure of three colors in the past is realized with only the sub-pixels 20R, 20G, and 20B, without the sub-pixel 20W in the sub-pixel structure of four colors of R G, B, and W like the present embodiment, the result is as follows. That is, for example, as illustrated in FIG. 18A, in the case of (R0, G0, B0)=(1, 0, 0), (R1, G1, B1, W1)=(4/3, 0, 0, 0) holds and a 4/3-time luminance level is desired. In addition, conversely, when the as-is luminance level (here, when R1=1) is used, the luminance level decreases to a 3/4-time level.

In addition, the sub-pixel 20W corresponding to W is not provided with a color filter as mentioned above and therefore, the same luminance level as that of white light synthesized in the sub-pixels 20R, 20G, and 20B corresponding to three colors of R, G, and B may be obtained with only this sub-pixel 20W. Therefore, for example, as illustrated in FIG. 18B, when (R0, G0, B0)=(1, 1, 1), (R1, G1, B1, W1)=(0, 0, 0, 4/3) holds.

Figure 18C:
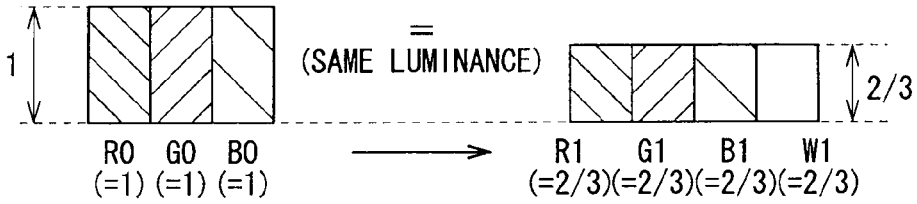

Based on these facts, for example, as illustrated in FIG. 18C, when (R0, G0, B0)=(1, 1, 1), (R1, G1, B1, W1)=(2/3, 2/3, 2/3, 2/3) may be assumed. In other words, in the sub-pixel structure of four colors of R G, B, and W, the same luminance level as that in the case of the sub-pixel structure of three colors of R, G, and B in the past may be realized with a 2/3-time luminance level in each color. Based on the foregoing, when this is applied to the RGB/RGBZ conversion described in the first embodiment, the following expressions (18) and (19) hold.

$$Xr=Xg=Xb=1, Xz=4/3 \tag{18}$$

$$kr=kg=kb=4/3 \tag{19}$$

Further, the expressions (7) to (9) described in the first embodiment may be expressed by the following expressions (20) to (22), respectively. Furthermore, the expressions (10) and (11) defining the candidate values Z1*a* and Z1*b* of Z1 may be expressed by the following expressions (23) and (24) defining candidate values W1*a* and W1*b* of W1, respectively.

$$\begin{cases} R1 = \left(R0 - \frac{3}{4}W1\right) \times (4/3) \geqq 0 & (20) \\ G1 = \left(G0 - \frac{3}{4}W1\right) \times (4/3) \geqq 0 & (21) \\ B1 = \left(B0 - \frac{3}{4}W1\right) \times (4/3) \geqq 0 & (22) \end{cases}$$

$$\begin{cases} W1a = \min\left(\frac{4}{3}R0, \frac{4}{3}G0, \frac{4}{3}B0\right) & (23) \\ W1b = \max\left(\frac{R0}{\left(\frac{3}{2}\right)}, \frac{G0}{\left(\frac{3}{2}\right)}, \frac{B0}{\left(\frac{3}{2}\right)}\right) & (24) \end{cases}$$

Next, with reference to FIG. 17 again, based on the above description, each block in the RGB/RGBW conversion section 422C will be described.

The W1 calculation section 422C1 calculates W1*a* which is a candidate value of W1, by using the above-described expression (23), based on the pixel signals D2*r*, D2*g*, and D2*b* (R0, G0, B0).

The W1 calculation section 422C2 calculates W1*b* which is a candidate value of W1, by using the above-described expression (24), based on the pixel signals D2*r*, D2*g*, and D2*b* (R0, G0, B0).

The Min selection section 422C3 selects either W1*a* outputted from the W1 calculation section 422C1 or W1*b* outputted from the W1 calculation section 422C2, whichever is smaller in value, and outputs the selected one as the ultimate W1.

Each of the multiplication sections 422C4R, 422C4G, and 422C4B multiplies W1 outputted from the Min selection section 422C3 by a predetermined constant (3/4) and outputs the result.

The subtraction section 422C5R subtracts the value (multiplied value) outputted by the multiplication section 422C4R from the pixel signal D2*r* (R0), and outputs the result. The subtraction section 422C5G subtracts the value (multiplied value) outputted by the multiplication section 422C4G from the pixel signal D2*g* (G0), and outputs the result. The subtraction section 422C5B subtracts the value (multiplied value) outputted by the multiplication section 422C4B from the pixel signal D2*b* (B0), and outputs the result.

The multiplication section 422C6R multiplies the value (subtracted value) outputted from the subtraction section 422C5R by a predetermined constant (4/3), and outputs the result as the pixel signal D3*r* (R1). The multiplication section 422C6G multiplies the value (subtracted value) outputted from the subtraction section 422C5G by a predetermined constant (4/3), and outputs the result as the pixel signal D3*g* (G1). The multiplication section 422C6B multiplies the value (subtracted value) outputted from the subtraction section 422C5B by a predetermined constant (4/3), and outputs the result as the pixel signal D3*b* (B1).

(RGB/RGBW Conversion Section 422D)

The RGB/RGBW conversion section 422D subjects the primary partitioning-drive signal D4 (D4*r*, D4*g*, D4*b*) corresponding to three colors of R, G, and B to RGB/RGBW conversion process (second color conversion process). As a result, the partitioning-drive image signal D5 (D5*r*, D5*g*, D5*b*, D5*w*) corresponding to the four colors of R, G, B, and W is generated. Therefore, the block configuration of the RGB/RGBW conversion section 422D is similar to that of the RGB/RGBW conversion section 422C except that the calculated W1 is also outputted as the pixel signal D5*w*.

Figure 19:
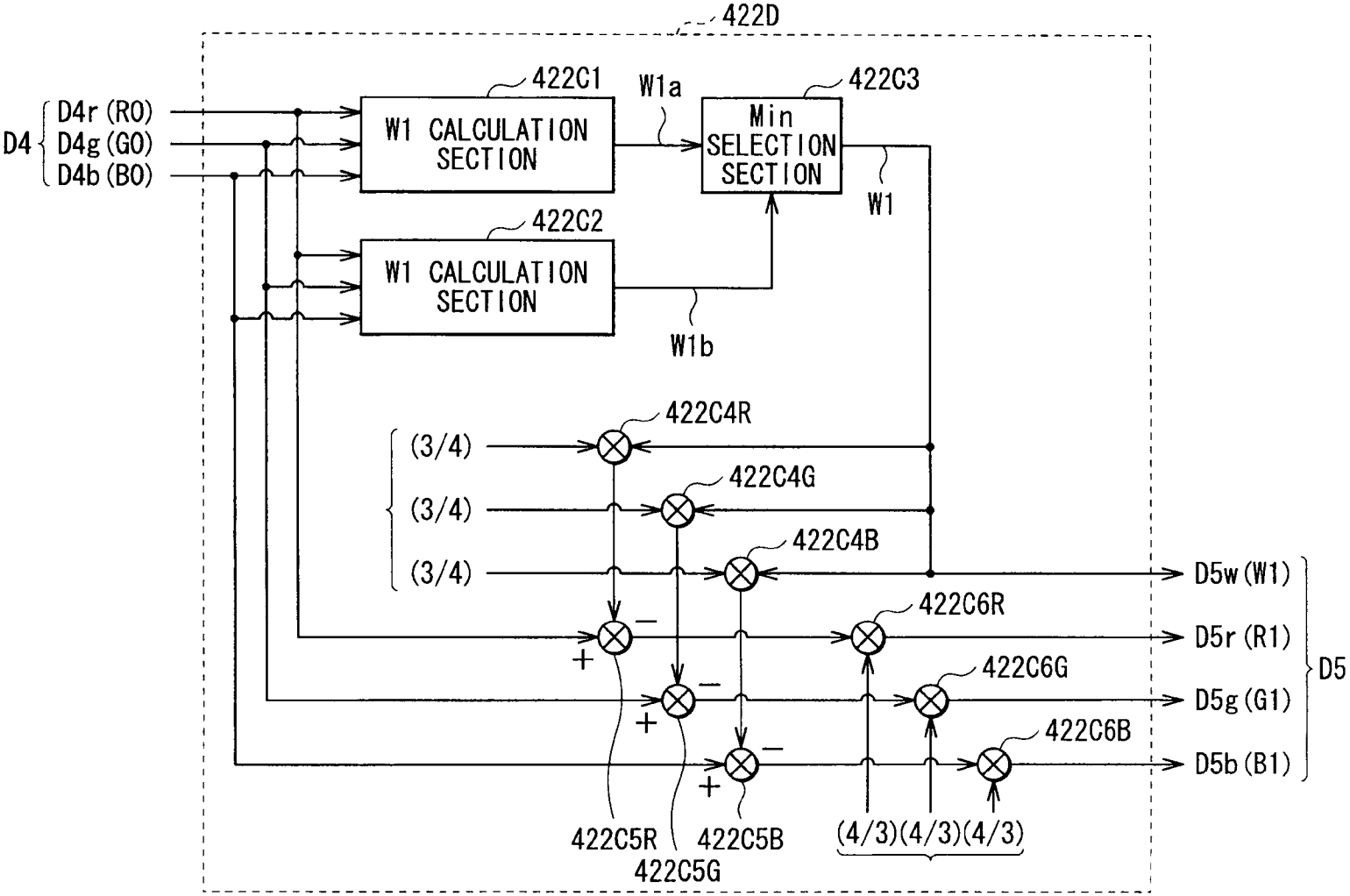
FIG. 19 is a block diagram illustrating a detailed structure of a RGB/RGBW conversion section 422D illustrated in FIG. 16.

FIG. 19 is a block diagram of this RGB/RGBW conversion section 422D. This RGB/RGBW conversion section 422D includes a W1 calculation section 422C1, a W1 calculation section 422C2, a Min selection section 422C3, multiplication sections 422C4R, 422C4G, and 422C4B, subtraction sections 422C5R, 422C5G, and 422C5B, and multiplication sections 422C6R, 422C6G, and 422C6B.

[Operation and Effect of LCD 1A]

With the LCD 1A of the present embodiment thus configured, an effect by an operation similar to those in the LCD 1 of the first embodiment may be obtained. In other words, at the time when image display is performed by using the light source section performing the sub-sectional emission operation, compatibility between a reduction in cost and a reduction in power consumption or similar effect may be realized.

Further, the pixel 20-1 of the present embodiment includes the sub-pixel 20W for W as an example of the sub-pixel 20Z described in the first embodiment and thus, there may not be a need to provide a color filter for this sub-pixel 20W, and in particular, luminance efficiency may be improved (power consumption may be reduced).

(Modification)

Up to this point, the present disclosure has been described by using some embodiments, but the present disclosure is not limited to these embodiments and may be variously modified.

For example, the embodiments have been described above for the case in which the image signal after its resolution is lowered is subjected to the RGB/RGBZ conversion process (RGB/RGBW conversion process), but the present disclosure is not limited to this case. In other words, the RGB/RGBZ conversion process (RGB/RGBW conversion process) may be performed before the resolution-lowering process is carried out in some cases.

Further, the embodiments have been described above for the case in which the backlight includes the red LED, green LED, and blue LED as the light sources, but the backlight may include a light source emitting light of other color, in addition to (or in place of) these LEDs. For example, in the case of a configuration including light of four or more colors, the color reproduction range may be expanded, and more various colors may be expressed.

Figure 20A:
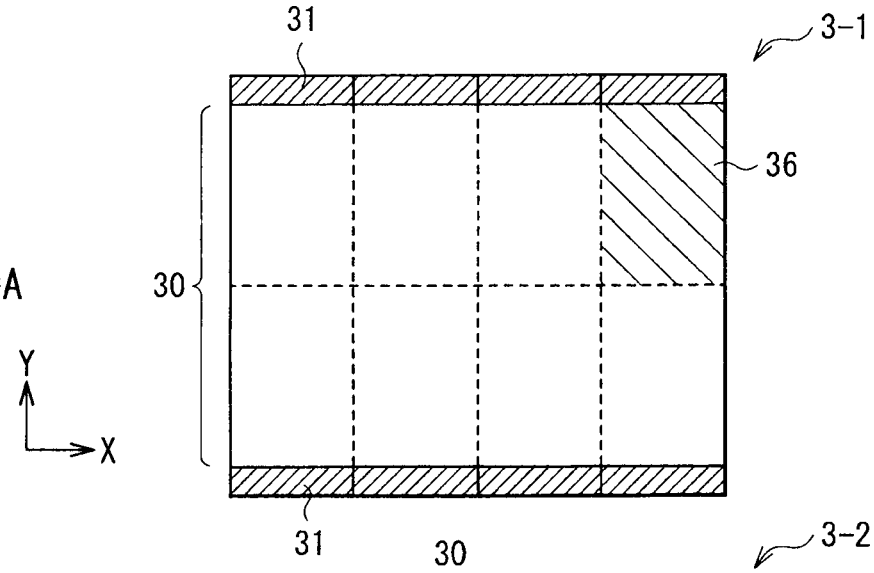
FIGS. 20A to 20C are schematic diagrams each illustrating sub-sectional emission operation in a backlight according to modifications of the present disclosure.
Figure 20B:
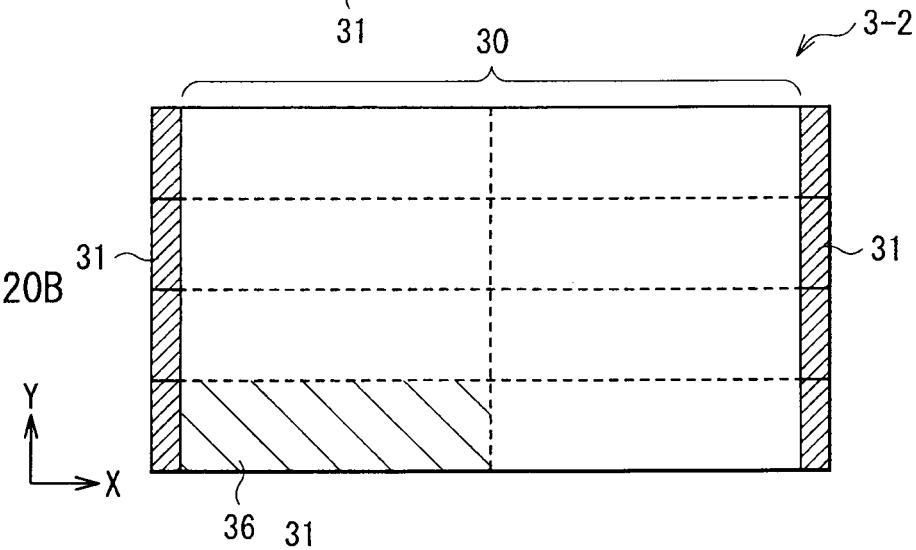
Figure 20C:
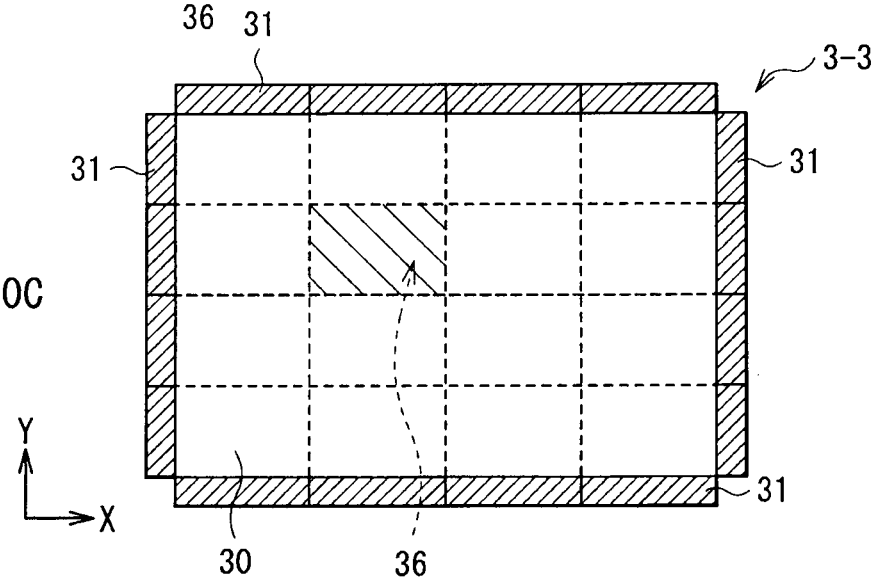

Furthermore, the embodiments have been described above by taking, as an example, the case where the backlight 3 is the so-called direct-lighting type of backlight (light source unit). However, the present disclosure may be applied to the so-called edge-lighting type of backlight, like backlights 3-1 to 3-3 illustrated in FIGS. 20A to 20C, for example. Specifically, each of these backlights 3-1 to 3-3 includes, for example, a light-guiding plate 30 having a emitting surface and shaped like a rectangle, and a plurality of light sources 31 disposed on the sides of this light-guiding plate 30 (sides of the emitting surface). Specifically, in the backlight 3-1 illustrated in FIG. 20A, the plurality of (four in this case) light sources 31 are disposed on each of one pair of opposite sides (sides in a vertical direction) in the light-guiding plate 30 shaped like a rectangle. Further, in the backlight 3-2 illustrated in FIG. 20B, the plurality of (four in this case) light sources 31 are disposed on each of one pair of opposite sides (sides in a lateral direction) in the light-guiding plate 30 shaped like a rectangle. Furthermore, in the backlight 3-3 illustrated in FIG. 20C, the plurality of (four in this case) light sources 31 are disposed on each side of two pairs of opposite sides (sides in vertical and lateral directions) in the light-guiding plate 30 shaped like a rectangle. In the backlights 3-1 to 3-3, due to the above-described configurations, a plurality of sub-sectional emission areas 36 that are controllable independently of each other are formed on the emitting surface of the light-guiding plate 30.

In addition, a series of processes described above for the embodiments may be performed by hardware, and also by software. In a case in which the series of processes are performed by software, the program of the software is installed on a general-purpose computer or the like. Such a program may be stored beforehand in a recording medium built in the computer.

The present disclosure contains subject matter related to that disclosed in Japanese Priority Patent Application JP 2010-114656 filed in the Japan Patent Office on May 18, 2010, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid crystal display comprising:

a light source section including a plurality of emission subsections each controlled independently;

a liquid crystal display panel including a plurality of pixels each having a red (R)-sub-pixel, a green (G)-sub-pixel, a blue (B)-sub-pixel, and a Z-sub-pixel, the Z-sub-pixel exhibiting a color of Z with luminance higher than that of the R-, G-, and B-sub-pixels, the liquid crystal display panel modulating light emitted from each of the emission subsections in the light source section based on three input image signals for R, G, and B, thereby performing image display; and circuitry configured to generate both an emission pattern signal and four partitioning-drive image signals from the three input image signals, the emission pattern signal representing an emission pattern formed by lighting emission subsections in the light source section, the four partitioning-drive image signals respectively corresponding to the four colors of R, G, B, and Z, the circuitry performing light-emission drive on the emission subsections in the light source section with use of the emission pattern signal, the emission pattern signal generated based on a signal consisting of the four partitioning-drive image signals respectively corresponding to the four colors of R, G, B, and Z, and performing display-drive on the R-, G-, B-, and Z-sub-pixels in the liquid crystal display panel with use of the four partitioning-drive image signals, wherein the circuitry is further configured to:

convert the three input image signals from a luminance level signal per pixel of the liquid crystal display panel to a luminance level signal per emission subsection area of the light source section, then generate four first conversion signals for R, G, B, and Z through performing a first color conversion based on the three input image signals after being converted to the luminance level signal per emission subsection area of the light source section, then generate the emission pattern signal from three first conversion signals for R, G, and B, of the four first conversion signals for R, G, B, and Z after the first color conversion by analyzing a luminance level per emission subsection area of the light source section for the three first conversion signals for R, G, and B, of the four first conversion signals for R, G, B, and Z after the first color conversion, the three first conversion signals for R, G, and B, of the four first conversion signals for R, G, B, and Z after the first color conversion being different from the three input image signals after being converted to the luminance level signal per emission subsection area of the light source section, then generate a diffused emission pattern signal from the emission pattern signal by converting the luminance level signal per emission subsection area of the light source section to the luminance level signal per pixel of the liquid crystal display panel by considering diffusion distribution of light from the light source section, then generate three primary partitioning-drive image signals for R, G, and B from both the three input image signals and the diffused emission pattern signal by dividing the three input image signals by the diffused emission pattern signal, and then generate the four partitioning-drive image signals through performing a second color conversion on the three primary partitioning-drive image signals.

2. The liquid crystal display according to claim 1, wherein the circuitry generates resolution-lowered signals for R, G, and B through performing resolution-lowering processes on the three input image signals, respectively, and then generates the four first conversion signals for R, G, B, and Z through performing the first color conversion on the resolution-lowered signals.

3. The liquid crystal display according to claim 2, wherein the circuitry performs a diffusion process on the emission pattern signal, and generates the three primary partitioning-drive image signals from both the three input image signals and the diffused emission pattern signal as a resultant of the diffusion process.

4. The liquid crystal display according to claim 1, wherein the Z-sub-pixel is a white (W)-sub-pixel.

5. The liquid crystal display according to claim 4, wherein the R-, G-, and B-sub-pixels are each provided with a corresponding color filter, whereas the W-sub-pixel is provided with no color filter.

6. The liquid crystal display according to claim 1, wherein the light source section is of a direct-lighting type or an edge-lighting type.

7. The liquid crystal display according to claim 1, wherein the circuitry generates the four first conversion signals for R, G, B, and Z by performing the first color conversion at a lower resolution than for the second color conversion.

8. The liquid crystal display according to claim 1, wherein the circuitry performs the first color conversion by extracting a mean value of a luminance level of pixel signals within each emission subsection area.

9. The liquid crystal display according to claim 1, wherein luminance levels of each of the three first conversion signals for R, G, and B, of the four first conversion signals for R, G, B, and Z after the first color conversion are lower than luminance levels of each of the corresponding three input image signals after being converted to the luminance level signal per emission subsection area of the light source section.

10. The liquid crystal display according to claim 1, wherein a luminance level of one first conversion signal for Z, of the four first conversion signals for R, G, B, and Z after the first color conversion is equal to or lower than the maximum luminance level of the three first conversion signals for R, G, and B, of the four first conversion signals for R, G, B, and Z after the first color conversion.

* * * * *